US008430396B2

(12) United States Patent
Holland-Letz et al.

(10) Patent No.: US 8,430,396 B2
(45) Date of Patent: Apr. 30, 2013

(54) VOUCHER CASSETTE

(75) Inventors: Günter Holland-Letz, Paderborn (DE); Ayhan Aslan, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/263,697

(22) PCT Filed: Apr. 9, 2010

(86) PCT No.: PCT/EP2010/054718

§ 371 (c)(1),
(2), (4) Date: Oct. 10, 2011

(87) PCT Pub. No.: WO2010/115988

PCT Pub. Date: Oct. 14, 2010

(65) Prior Publication Data

US 2012/0032391 A1 Feb. 9, 2012

(30) Foreign Application Priority Data

Apr. 9, 2009 (DE) ..... 10 2009 017 220

(51) Int. Cl.
*B65H 1/00* (2006.01)

(52) U.S. Cl.
USPC ..... 271/145; 271/287; 271/213

(58) Field of Classification Search ..... 271/287, 271/289, 290, 292, 207, 213, 214, 145
See application file for complete search history.

(56) References Cited

U.S. PATENT DOCUMENTS

| | | | | |
|---|---|---|---|---|
| 5,152,512 | A | 10/1992 | Yoshida et al. | |
| 6,786,354 | B2 * | 9/2004 | Black et al. | 221/6 |
| 2002/0148894 | A1 | 10/2002 | Gerlier | |
| 2005/0200073 | A1 | 9/2005 | Mizuno | |
| 2005/0263582 | A1 * | 12/2005 | Yokoi et al. | 235/379 |

FOREIGN PATENT DOCUMENTS

| | | | |
|---|---|---|---|
| DE | 4008973 | C1 | 7/1991 |
| DE | 4200186 | C1 | 7/1993 |
| DE | 202007018498 | U1 | 10/2008 |
| DE | 202008006688 | U1 | 10/2008 |
| EP | 1130551 | A2 | 9/2001 |
| EP | 1603085 | A1 | 12/2005 |
| WO | WO-0133523 | A1 | 5/2001 |

OTHER PUBLICATIONS

International Seach Report (in English) and Written Opinion of the International Searching Authority (in German) for PCT/EP2010/054718, mailed Aug. 11, 2010; ISA/EP.
Notification of Transmittal of copies of Translation of International Preliminary Report on Patentability for PCT/EP2010/054718 mailed Oct. 24, 2011 (11 Pages).

* cited by examiner

*Primary Examiner* — Michael McCullough
(74) *Attorney, Agent, or Firm* — Harness, Dickey & Pierce, P.L.C.

(57) ABSTRACT

A value note cassette comprising a fixed first storage compartment for receiving notes of value and at least a fixed second storage compartment for receiving notes of value. Further, the value note cassette comprises a supply unit for supplying the notes of value to the storage compartments. The storage compartments are designed such that notes of value are stackable therein.

29 Claims, 25 Drawing Sheets

VOUCHER CASSETTE

CROSS-REFERENCE TO RELATED APPLICATIONS

This application is a National Stage of International Application No. PCT/EP2010/054718, filed Apr. 9, 2010, and published in the German language as WO 2010/115988 A1 on Oct. 14, 2010. This application claims the benefit and priority of German application 10 2009 017 220.3, filed Apr. 9, 2009. The entire disclosures of the above applications are incorporated herein by reference.

BACKGROUND

This section provides background information related to the present disclosure which is not necessarily prior art.

1. Technical Field

The invention relates to a value note cassette having a fixed first storage compartment for receiving notes of value and a supply unit for supplying the notes of value to the storage compartment. The storage compartment is designed such that notes of value are stackable therein.

2. Discussion

The invention is in particular used in connection with automated teller machines into which notes of value, preferably banknotes, are deposited and/or from which notes of value are withdrawn. Automated teller machines usually comprise a first value note cassette in which notes of value are stored that were provided in an output compartment for withdrawal by a customer but were not taken out by the customer. Further, known automated teller machines have a second value note cassette for receiving notes of value that are suspected of being counterfeit and a third value note cassette for receiving notes of value that are to be removed from circulation. The use of three value note cassettes has the disadvantage that much installation space is required for these three value note cassettes.

An alternative possibility of storing notes of value that are to be removed from circulation, notes of value that are suspected of being counterfeit and notes of value that were not taken out is to store the notes of value that are to be removed from circulation and the notes of value that are suspected of being counterfeit as well as the notes of value that were not taken out in only one value note cassette. Here, it is disadvantageous that, when this cassette is emptied by a security transport company, the notes of value have to be sorted by the security transport company according to notes of value that are to be removed from circulation, notes of value that are suspected of being counterfeit and notes of value that were not taken out. This incurs considerable additional expenses. Further, the sorting of the notes of value might not be possible at all or only possible with much difficulty.

From the document DE 40 08 973 C1, a container for receiving notes of value in a value note withdrawal machine with a closable housing having an inlet opening for the notes of value is known. The container comprises a plurality of compartments for receiving notes of value, wherein the receiving openings of the compartments can be optionally connected to the inlet opening. Here, it is disadvantageous, on the one hand, that in the compartments only a small amount of notes of value can be received and, on the other hand, that, as a result of the pivoting of the compartments, the speed at which the notes of value can be supplied to the compartments is relatively low.

From the document DE 20 2007 018 498 U1, an automated teller machine for the output of banknotes is known, comprising at least one banknote storage, a pull-off and separating device, an output compartment and a device fashioned in the form of a roll storage for receiving banknotes that were not taken out.

SUMMARY OF THE INVENTION

It is an object of the invention to specify a value note cassette which has a compact structure, in which different notes of value can be stacked separately and to which the notes of value can be supplied at a high speed.

Due to the fact that the value note cassette has two storage compartments it is achieved that different notes of value, in particular notes of value that are assigned to different value note classes, can be stored spatially separately. Compared to a value note cassette in which the storage compartments have to be moved when notes of value are received, a higher supply speed for supplying the notes of value to the storage compartments is achieved by the fixed arrangement of the storage compartments. By storing the notes of value in the value note compartments in the form of value note stacks an orderly storage is achieved, as a result whereof malfunctions, in particular value note jams, are prevented and a large number of notes of value is receivable in the storage compartments. Further, in this way the orderly removal of the notes of value from the storage compartments is made easier. For this, the value note cassette is preferably removable from the automated teller machine.

It is advantageous to provide at least one third storage compartment for receiving notes of value, this third storage compartment likewise being fashioned such that the notes of value are stackable therein. In this way, it is achieved that in one value note cassette notes of value that are to be removed from circulation, and notes of value that were not taken out, as well as notes of value that are suspected of being counterfeit can be received and separately stored. Alternatively, also two storage compartments for receiving notes of value that were not taken out and one storage compartment for receiving notes of value that are to be removed from circulation can be used. Likewise, it is possible to use two storage compartments for receiving notes of value that are to be removed from circulation and only one storage compartment for receiving notes of value that were not taken out. Further, the storage compartments can also be used for receiving notes of value that are to remain in circulation. The storage compartments are in particular fashioned such that all notes of value that are in circulation are receivable therein and that the allocation as to which notes of value are to be received in which storage compartment is freely selectable.

Further, it is advantageous when the dimensions of the value note cassette correspond to the dimensions of common value note cassettes that only have one storage compartment for receiving notes of value. In this way, it is achieved that the value note cassette can be inserted into known automated teller machines without any structural changes or only with slight changes.

In addition, it is advantageous when the value note cassette comprises a base and a cover for closing an opening of the base. It is particularly advantageous when the base comprises a bottom plate, a first side wall, a second side wall, a rear wall and a front wall. The storage compartments are preferably arranged in the base and the supply unit is arranged in the cover. Advantageously, the cover is removable from the base or is a folding cover. In this way, it is achieved that the notes of value received in the storage compartments can easily be removed from the storage compartments in the base when the cover is removed or hinged open. By arranging the supply unit in the cover, it is achieved that the storage compartments can easily be accessed when the cover is removed or, respectively, hinged open, without further component parts of the supply unit having to be removed.

It is advantageous when the cover is firmly connectable to the base by means of a locking mechanism. This prevents access to the notes of value received in the value note cassette by unauthorized people or at least makes access more difficult.

In a preferred embodiment of the invention each storage compartment has a respective storage area for receiving the notes of value. Each of the storage areas is delimited by a part of the bottom plate, a part of the first side wall, a part of the second side wall, a fixed wall and a press-on wall mounted movably in the stacking direction of the notes of value. By movably mounting the press-on wall, it is achieved that the size of the storage area of the respective storage compartment is variable, in particular that the storage area is always only slightly larger than the value note stack received in the storage area. This guarantees that the notes of value can be stored in the form of an orderly stack. In particular, a tipping over of the notes of value of the value note stack is prevented.

Each press-on wall is preferably mounted via a respective first gear wheel on a first toothing of the first side wall, a respective second gear wheel on a first toothing of the second side wall, a respective first roll in a first groove of the first side wall, a respective second roll in a second groove of the first side wall, a respective third roll in a first groove of the second side wall and/or a respective fourth roll in a second groove of the second side wall. In this way, it is achieved that the press-on wall and the elements for mounting the press-on wall are fashioned as narrow as possible so that little installation space is required and the storage areas of the storage compartments are as large as possible. In this way, a relatively large stacking area for stacking notes of value is available in the value note cassette.

It is advantageous when the press-on wall does not contact the bottom plate. Thus, it is achieved that the press-on wall can be displaced in the stacking direction as easily as possible as there is no friction between the press-on wall and the bottom plate. In particular, it is achieved in this way that no drive unit for displacing the press-on wall is required but the press-on wall is displaceable in the stacking direction only by means of the pressure exerted on the press-on wall by the note stack.

Each press-on wall is preferably connected to the first side wall or the second side wall by means of at least one elastic element. The elastic element keeps the press-on wall in a position in which the press-on wall of a storage compartment has a minimum distance to the fixed wall of the storage compartment so that between the press-on wall and the fixed wall a supply area for supplying the notes of value is formed. By means of the elastic element it is guaranteed that this supply area is only as large as required for a proper supply of the further note of value. In this way, it is achieved that the notes of value are stacked in a reliable and non-destructive manner. The elastic element is in particular a tension spring, preferably a long tension spring with a flat characteristic curve.

In addition, it is advantageous when each fixed wall has at least one recess through which a part of a roll rotatably mounted on the side of the fixed wall facing away from the storage area projects into the storage area. The roll contacts the notes of value when the notes of value are supplied to the storage area so that the friction between the note of value to be supplied and the fixed wall is reduced or, respectively, fully prevented. This prevents that the note of value to be supplied gets caught and/or is bent so that a proper supply of the notes of value is guaranteed.

It is particularly advantageous when each fixed wall comprises at least one spacer by which notes of value whose short sides fall below a minimum length are at least temporarily kept at a distance to the bottom plate during stacking of the notes of value into the storage area. The fixed wall preferably comprises a second recess through which the spacer mounted on the side of the fixed wall facing away from the storage area and connected to this wall via at least one elastic element projects into the storage area. By means of this spacer, it is achieved that also notes of value whose short sides fall below the minimum length can be contacted by vanes of vane wheels arranged above the storage compartments so that the notes of value are pressed against the value note stack received in the storage area by the vane wheels or, respectively, the value note stack is pressed against the press-on wall.

In a preferred embodiment of the invention, the bottom plate has at least one, preferably a plurality of rib-like projections extending in the removal direction of the notes of value on the surface delimiting the storage area. The rib-like projection is preferably polished. In this way, it is guaranteed that the friction between the notes of value received in the storage area and the bottom plate is reduced so that the notes of value of the value note stack are more easily displaceable in the stacking direction and/or an adherence of the note of value to the surface delimiting the storage area is prevented.

The storage compartments are preferably arranged behind one another as viewed in the transport direction of the notes of value. Thus, a best-possible utilization of the space of the value note cassette is achieved so that as many notes of value as possible are receivable in the value note cassette.

In a particularly preferred embodiment of the invention the cover only has one inlet opening through which the notes of value to be supplied to the storage compartments are supplied to the supply unit. In this way, it is achieved that only one inlet opening has to be protected against manipulation so that the manipulation safety of the value note cassette is considerably increased compared to a value note cassette in which a single receiving opening is provided for each storage compartment.

In addition, it is advantageous when the supply unit is drivable via a drive unit arranged outside the value note cassette. In this way, a drive unit arranged within the value note cassette can be dispensed with. As a result thereof, on the one hand, the costs are reduced and, on the other hand, the space available for receiving notes of value in the value note cassette is increased as no installation space is required for the drive unit within the value note cassette. The cover of the value note cassette in particular comprises a drive wheel which is engageable with a drive of the automated teller machine into which the value note cassette is inserted.

The notes of value are transported in the supply unit along a transport path in a transport direction. The transport direction is the direction in which the notes of value are transported coming from the inlet opening of the cover before they are supplied to one of the storage compartments. Advantageously, the transport path runs substantially horizontally.

It is advantageous when the transport path is delimited by at least one driven belt extending in the transport direction of the notes of value on the side facing away from the base, which belt contacts the notes of value to be transported and transports them in the transport direction. It is particularly advantageous when two belts arranged parallel to each other are provided for the transport of the notes of value in the transport direction. In this way, a uniform transport of the notes of value in the transport direction is achieved.

Further, it is advantageous when a housing of the cover comprises at least one rib by which the notes of value to be supplied to the storage areas are guided during the transport along the transport path at least in a section thereof. It is particularly advantageous when several ribs arranged parallel to one another are provided. By means of the ribs a reliable transport of the notes of value is achieved, and value note jams, in particular value note jams caused by a buckling of notes of value are prevented.

In a preferred embodiment of the invention the supply unit comprises at least one sorting gate for diverting notes of value from the transport path and for supplying the notes of value into one of the storage compartments. In a particularly preferred embodiment of the invention, the supply unit comprises several sorting gates, one sorting gate each being arranged such that by means of it notes of value can be supplied to one of the storage compartments. In particular, exactly one sorting gate is allocated to each storage compartment, which sorting gate diverts the notes of value to be supplied to the respective storage compartment from the transport path. Thus, it is easily achieved that the notes of value can be supplied to the different storage compartments.

It is advantageous when each sorting gate comprises a shaft and at least one, preferably several fingers connected to the shaft in a rotationally fixed manner. In a diverting position, the finger is arranged such that at least a part of a contact area of the finger projects into the transport path and supplies notes of value transported along the transport path to the storage compartment to which the sorting gate is allocated. The sorting gate which is allocated to the storage compartment that is arranged as the last storage compartment viewed in the transport direction can in particular be fashioned such that the fingers are always in the diverting position. Thus, this sorting gate is no real sorting gate that can be moved between at least two positions. In this way, all notes of value that have not been diverted by any of the sorting gates arranged upstream in the transport direction are automatically supplied to the last storage compartment.

The contact area of the fingers is preferably bent. The contact area is in particular bent by at least 90°. In this way, it is achieved that the notes of value are deflected by at least 90° when they are supplied to a storage compartment so that they rest against the fixed wall due to their internal stress when they are supplied to the storage compartments.

In addition, it is advantageous when between two fingers at least one roll is arranged rotatably on the shaft. The roll contacts the notes of value that are not to be supplied to the storage compartment allocated to the sorting gate and transports these notes of value further in the transport direction when the fingers of the sorting gate are arranged in a lower position. The lower position is the position in which the fingers are pivoted downward so far that they do not project into the transport path and thus do not divert any notes of value transported along the transport path. Advantageously, several rolls are arranged on the shaft. By means of these rolls, a guidance of the notes of value from below during the transport of the notes of value along the transport path is achieved. By arranging the rolls on the same shaft on which the fingers are arranged, the required installation space is reduced.

Further, it is advantageous when the shaft is a first shaft and when at least one roll for supplying the diverted notes of value to the storage compartment is provided, which roll is arranged on a second shaft running parallel to the first shaft and is connected to the second shaft in a rotationally fixed manner. The roll contacts the notes of value that have been diverted from the transport path by means of the respective sorting gate while these are supplied to the storage compartment. The second shaft is in particular driven so that the rolls likewise rotate and the notes of value are thus actively conveyed into the storage area. Several rolls are preferably arranged on the second shaft, the distance between two adjacent rolls preferably being the same each time.

Further, it is advantageous when at one end of the first shaft a lever element for pivoting the finger from the lower position into the diverting position is arranged, which lever element is connected via at least one elastic element to a side rail of the cover and which is connected to the first shaft in a rotationally fixed manner. The elastic element is arranged such that the finger is held in the lower position. Thus, by means of a simple and cost-efficient mechanism it is achieved that the sorting gate only diverts notes of value from the transport path when the lever element is actively pivoted and otherwise the fingers of the sorting gate are arranged in the lower position so that notes of value transported along the transport path are not diverted.

It is particularly advantageous when the base comprises a vertically extending translation element for transmitting a translatory movement, which element is movable in its longitudinal direction such that by means of it the finger is pivotable from the lower position into the diverting position as a result of a pivoting the lever element. In particular, by lifting the translation element it is achieved that it contacts a contact area of the lever element and pivots the lever element upward such that the first shaft that is connected to the lever element in a rotationally fixed manner is rotated such that the finger is pivoted from the lower position into the diverting position. It is particularly advantageous when the translation element is movable by means of a lifting magnet arranged outside the value note cassette. In this way, a drive unit in the value note cassette can be dispensed with.

Further, it is advantageous when all sorting gates of the supply unit are identically designed. In this way, an easy mounting is possible, and sorting gates can be obtained or, respectively, manufactured cost-efficiently.

Preferably, one respective transport unit for the transport of the notes of value along the transport path is provided between two adjacent sorting gates and/or between the inlet opening of the cover and the first sorting gate as viewed in the transport direction of the notes of value. It is advantageous when the transport units are mounted pivotally in the direction of the base. By means of this downward pivoting of the transport units, easy access to the transport path is made possible, as a result whereof potential value note jams can be removed easily.

Further, it is advantageous to arrange a third shaft upstream of each sorting gate as viewed in transport direction, on which third shaft at least one vane wheel comprising at least one vane is arranged. The vane presses a note of value to be supplied to the respective storage compartment against the value note stack already contained in the storage compartment and displaces the note of value, the value note stack and the press-on wall in the stacking direction of the notes of value. In this way, it is achieved that a supply opening for supplying a further note of value is formed so that the further note of value can be supplied to the storage compartment without the front edge of the note of value, as viewed in the supply direction of the notes of value, getting caught with the upper edges of the notes of value already received in the storage compartment.

BRIEF DESCRIPTION OF THE DRAWINGS

Further features and advantages of the invention result from the following description which, in connection with the enclosed Figures, explains the invention in more detail with reference to embodiments.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
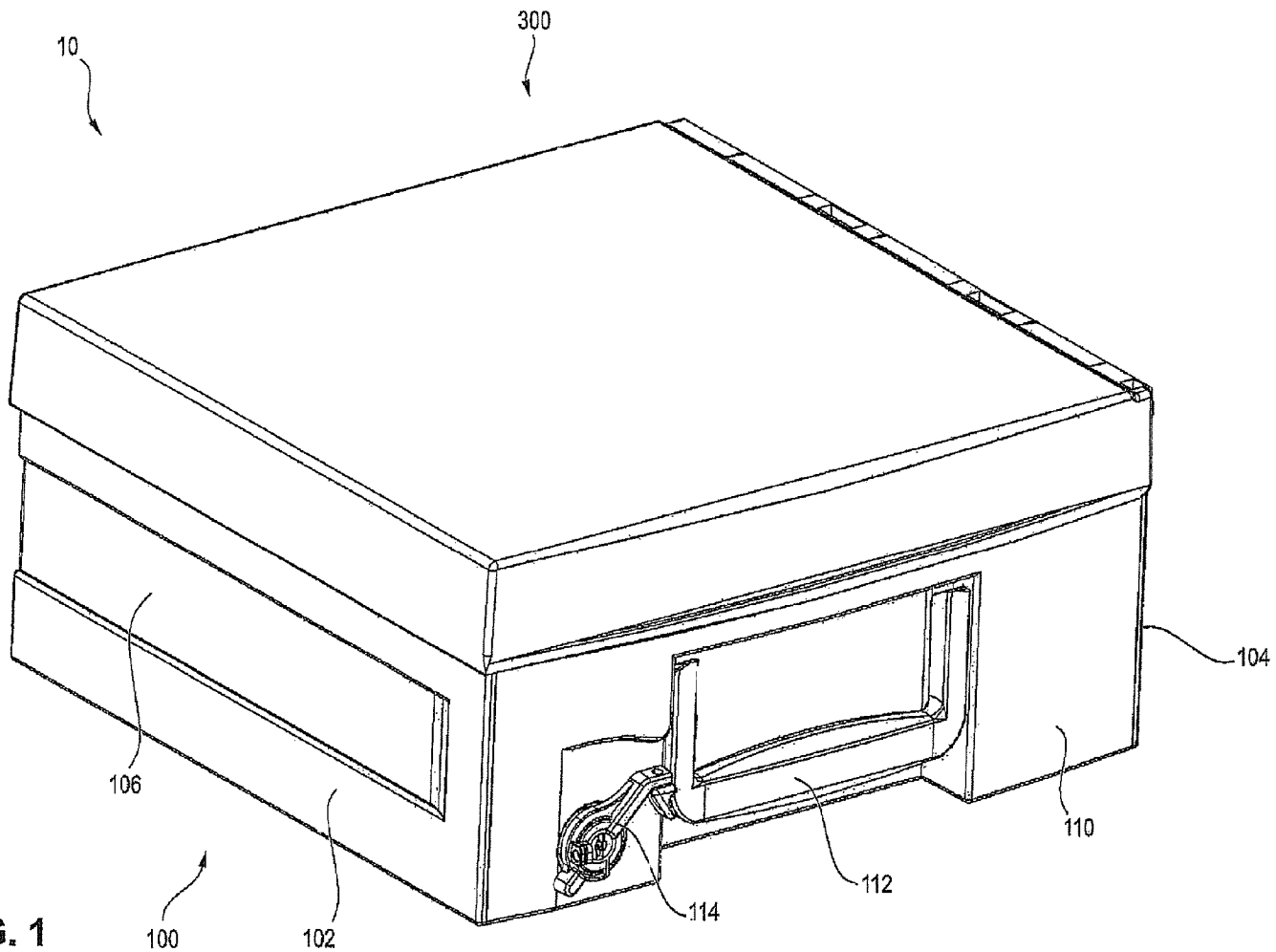
FIG. 1 shows a schematic perspective rear-view illustration of a value note cassette.

In FIG. 1, a schematic perspective rear-view illustration of a value note cassette 10 is shown. The value note cassette 10 is used, in particular, in connection with automated teller machines, automatic cash systems and/or automatic cash safes. In the following, a use of the value note cassette 10 in an automated teller machine is taken as an example. The notes of value are in particular banknotes. The notes of value deposited into the automated teller machine and/or those notes of value that were offered to an operator in an output compartment in the course of a withdrawal operation and were not taken out by the operator are supplied to value note cassettes and stored therein. The notes of value are in particular separated according to notes of value that were not taken out, notes of value that are to be removed from circulation, notes of value that are suspected of being counterfeit and notes of value that are to be withdrawn again from the machine. Those notes of value that are to be withdrawn again from the machine are further preferably stored separately according to the denominations of the notes of value.

The value note cassette 10 comprises a base 100 and a cover 300. The base 100 has an opening which is closeable by means of the cover 300. The opening of the base 100 in particular serves to remove notes of value received in the storage compartments 130*a* to 130*c* of the base 100.

The base 100 comprises a first side element 102, a second side element 104 and a rear wall 110. Both the first side element 102 and the second side element 104 have a respective groove-shaped recess 106, 108, by which the value note cassette 10 is received in rails of the automated teller machine in which the value note cassette 10 is used, which rails are complementary to the groove-shaped recesses 106, 108. The outer dimensions of the value note cassette 10 are in particular chosen such that the value note cassette 10 is receivable in common automated teller machines. At the rear wall 110 of the base 100, a handle 112 is arranged which can be folded out and by means of which the value note cassette 10 can be removed more easily from the automated teller machine and can then be carried. Further, on the rear wall 110, an actuating unit 114 of a locking mechanism 138 for closing the cover 300 is arranged. The locking mechanism 138 is still described in more detail in connection with the following Figures.

Figure 2:
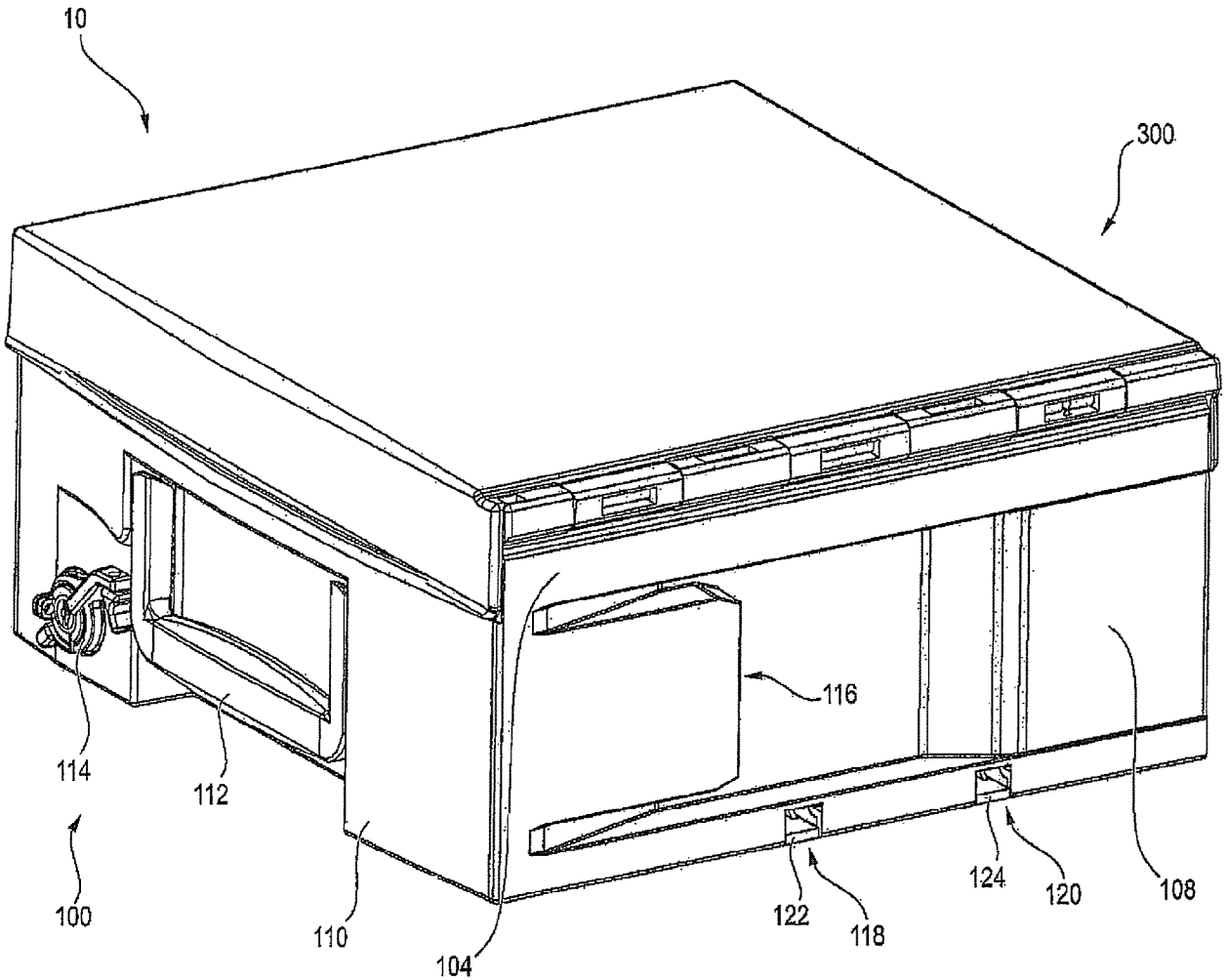
FIG. 2 shows a further schematic perspective rear-view illustration of the value note cassette according to FIG. 1.

In FIG. 2, a further schematic perspective rear-view illustration of the value note cassette 10 according to FIG. 1 is shown. Elements having the same structure or the same function are identified with the same reference signs.

In the groove-shaped recess 108 of the second side element 104, a plug connector 116 is arranged by which the electronics of the value note cassette 10 is connectable in an electrically conductive manner to the electronics of the automated teller machine in which the value note cassette is received. Further, the second side wall 104 comprises two recesses 118, 120, in each of which a lower end of a lifting rod 122, 124 is arranged. The lifting rods 122, 124 serve to actuate sorting gates 700*a*, 700*b* arranged in the cover 300, which sorting gates will still be described in more detail with reference to the following Figures. Likewise, the actuation of the sorting gates 700*a*, 700*b* by means of the lifting rods 122, 124 will still be explained in more detail further below.

Figure 3:
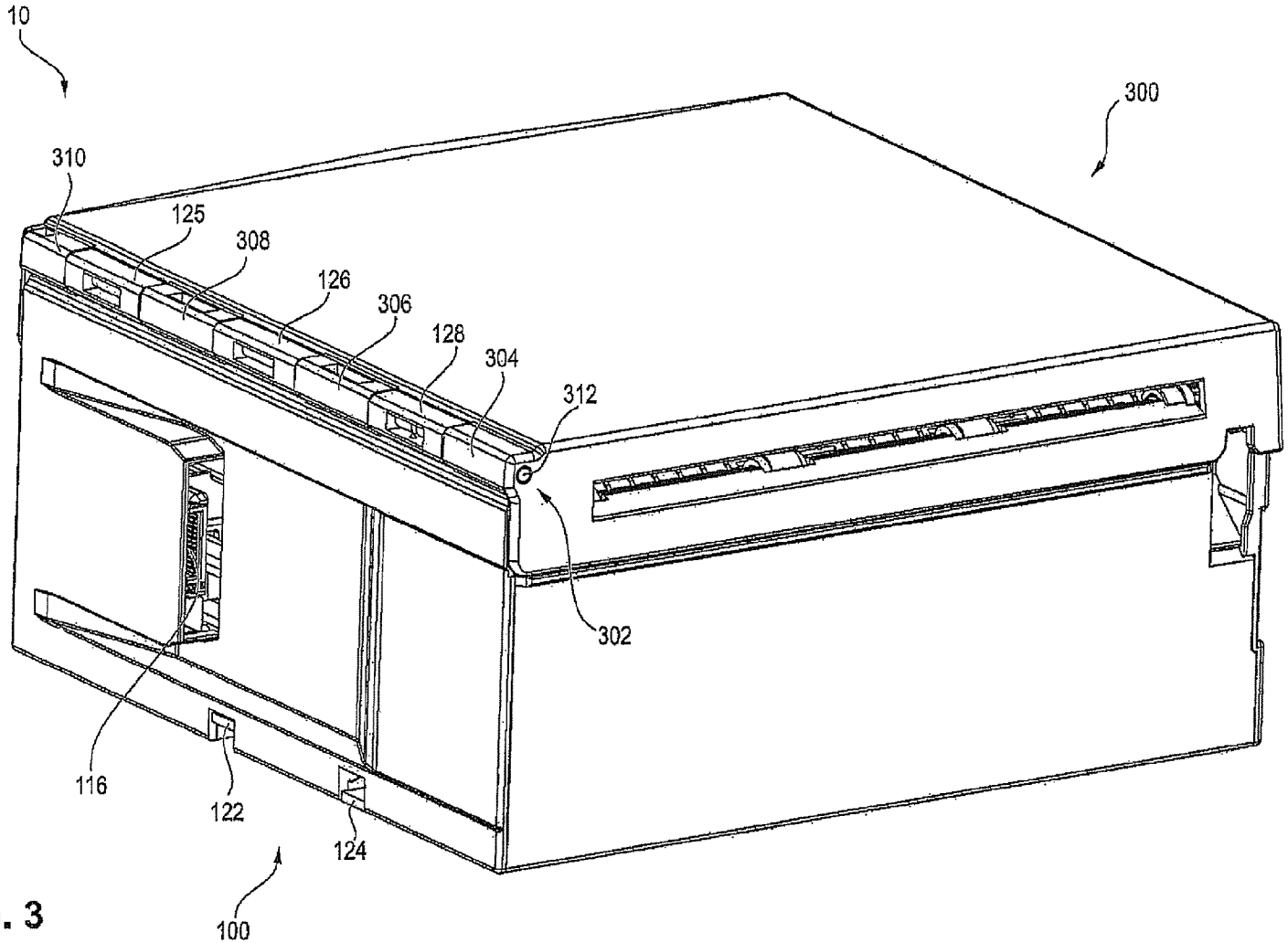
FIG. 3 shows a schematic perspective front-view illustration of the value note cassette according to FIGS. 1 and 2.

In FIG. 3, a schematic perspective front-view illustration of the value note cassette 10 according to FIGS. 1 and 2 is shown. The cover 300 and the base 100 are connected to each other via a hinge connection 302. For this, the cover comprises four connecting elements 304 to 310 and the base 100 comprises three connecting elements 125 to 128, which are connected to each other via a pin 312 such that the cover 300 is mounted rotatably relative to the base 100 about the longitudinal axis of the pin 312. For opening the value note cassette 10, the cover 300 is pivotable upward about the longitudinal axis of the pin 312 by means of the hinge connection 302.

Figure 4:
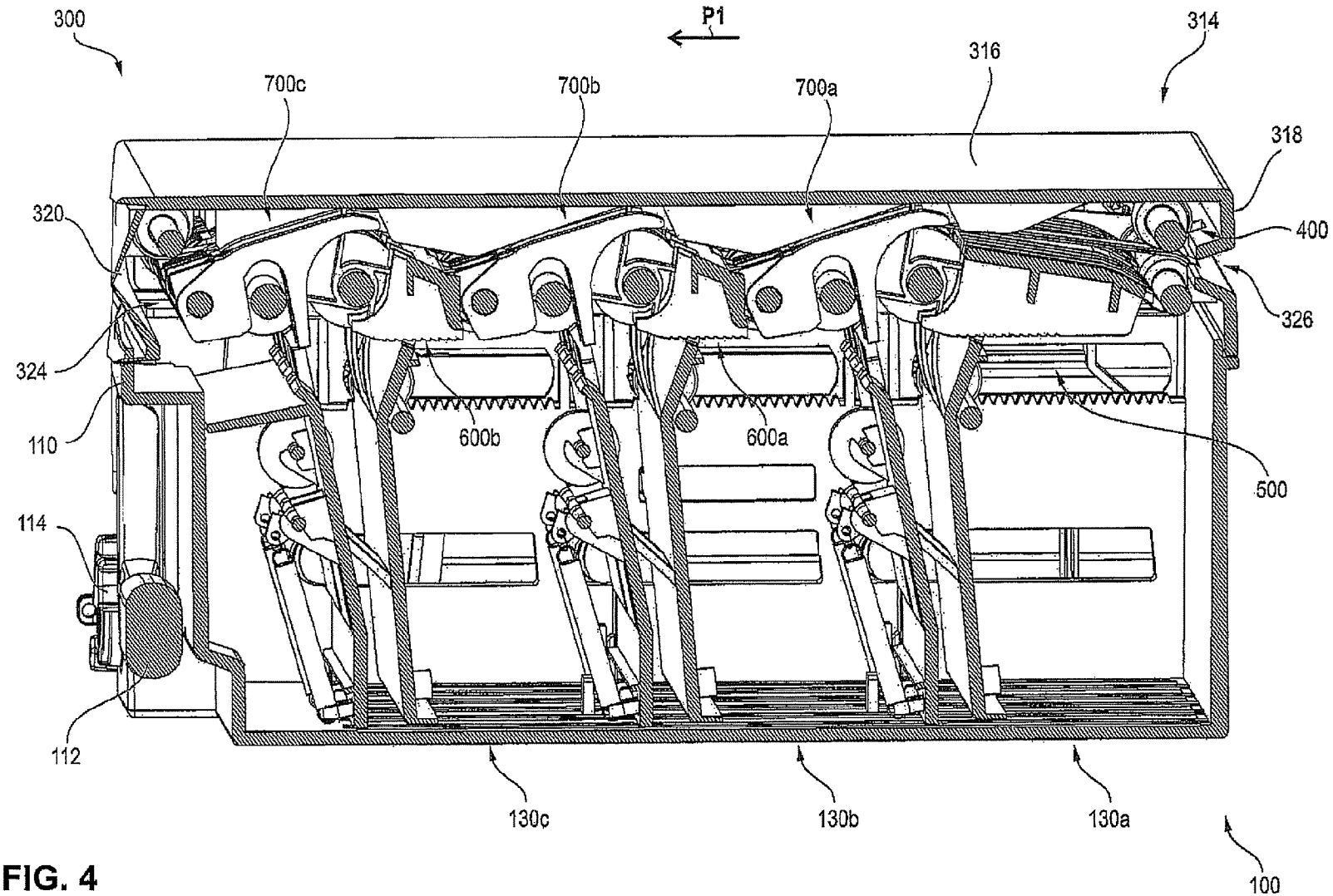
FIG. 4 shows a schematic perspective illustration of a longitudinal section of the value note cassette according to FIGS. 1 to 3.

In FIG. 4, a schematic perspective illustration of a longitudinal section of the value note cassette 10 according to FIGS. 1 to 3 is shown. In the base 100 of the value note cassette 10, three storage compartments 130*a* to 130*c* for receiving notes of value are arranged. In an alternative embodiment of the invention, also only two storage compartments 130*a* to 130*c* or more than three storage compartments 130*a* to 130*c* can be provided. In the storage compartments 130*a* to 130*c*, the notes of value supplied to the value note cassette 10 are stored in a stacked manner in an upright position on one of their long sides. Alternatively, the notes of value can also be stacked in an upright position on one of their short sides.

The storage compartments 130*a* to 130*c* are designed such that all notes of value that can be handled in the automated teller machine in which the value note cassette 10 is inserted can actually be received in the value note cassette 10. In particular, those notes of value that were offered to an operator of the automated teller machine for withdrawal and were not taken out by the operator are stored in one of the three storage compartments 130*a* to 130*c*, the notes of value which are to be removed from circulation are stored in another storage compartment 130*a* to 130*c*, and the notes of value classified as suspected of being counterfeit are stored in the third storage compartment 130*a* to 130*c*. Alternatively, also two storage compartments 130*a* to 130*c* can be used for notes of value that are to be removed from circulation, and one storage compartment 130*a* to 130*c* can be used for notes of value that were not taken out. Likewise, in two storage compartments 130*a* to 130*c*, notes of value that were not taken out and in one storage compartment 130*a* to 130*c* notes of value that are to be removed from circulation can be stored. Further, notes of value that are to remain in circulation can likewise be stored in the storage compartments 130*a* to 130*c*. Preferably, the configuration as to in which of the storage compartments 130*a* to 130*c* which notes of value or which types of notes of value are to be stored can freely be preset.

The cover 300 has a housing 314 comprising an upper wall 316, a front wall 318, a rear wall 320 and a side wall 322. In the cover 300, a supply unit 324 for supplying the notes of value to the storage compartments 130*a* to 130*c* is arranged. The notes of value to be stored in the storage compartments 130*a* to 130*c* are supplied to the value note cassette 10 through an inlet opening 326 in the cover 300. The inlet opening 326 is dimensioned as small as possible so that manipulation attempts are made more difficult. The supply unit 324 is designed such that all notes of value, independent of the storage compartment 130*a* to 130*c* in which they are to be stored, can be supplied to the value note cassette 10 through only one inlet opening 326. In an alternative embodiment of the invention, also three inlet openings 326 can be provided, wherein only those notes of value that are to be stored in the allocated storage compartment 130*a* to 130*c* are supplied via the respective inlet opening 326.

The supply unit 324 comprises an upper transport unit 400, a front-end transport unit 500 and two intermediate transport units 600*a*, 600*b*, by means of which the notes of value to be supplied to the storage compartments 130*a* to 130*c* are transported in a transport direction P1 along a transport path delimited by the transport units 400, 500, 600*a*, 600*b*. The transport path extends substantially horizontally.

Further, the supply unit 324 comprises three sorting gates 700*a* to 700*c* for diverting notes of value transported along the transport path and for supplying the diverted notes of value to one of the storage compartments 130*a* to 130*c*.

The structure and the function of the individual units and component parts will be described in more detail in connection with the respective Figures that are still to come.

Figure 5:
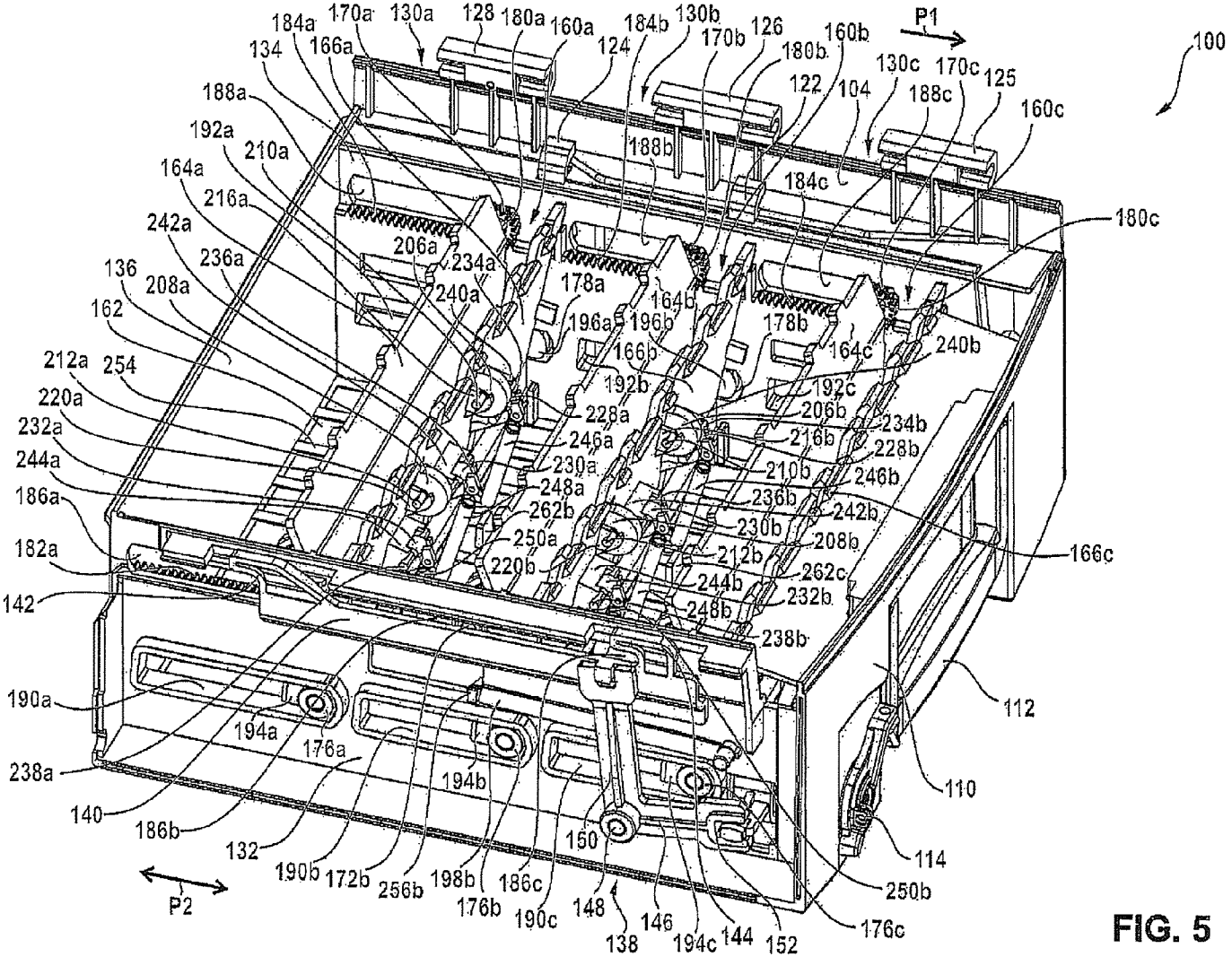
FIG. 5 shows a schematic perspective illustration of a base of the value note cassette according to FIGS. 1 to 4 in an unfilled state with a locking mechanism, with a view onto the first side wall.

In FIG. 5, a schematic perspective illustration of the base 100 is shown in the unfilled state, with a view onto the first side wall 132 of the base 100. The unfilled state is the state in which no note of value is yet received in the storage compartments 130*a* to 130*c* of the value note cassette 10.

The base 100 comprises a first side wall 132, a second side wall 134 and a front wall 136. The side walls 132, 134 are respectively firmly connected to the front wall 136 and the rear wall 110. Likewise, the first side element 102, which is not illustrated in FIG. 5, and the second side element 104 are respectively firmly connected to the rear wall 110 and the front wall 136. Between the first side wall 132 and the first side element 102 as well as between the second side element 104 and the second side wall 134 a respective space is formed, in which component parts of the base 100 are arranged.

In the space formed between the first side wall 132 and the first side element 102, the locking mechanism 138 for closing the cover 300 on the base 100 is arranged. The locking mechanism 138 comprises a lock bar 140 having two hooks 142, 144. Further, the locking mechanism 138 comprises an angle element 146 which is mounted rotatably about an axis of rotation 148 and whose first leg 150 is engaged with the lock bar 142 and whose second leg 152 is engaged with the actuating unit 114. When the actuating unit 114 is actuated, then the angle element 146 is rotated such that the lock bar 140 is moved in the direction of the double arrow P2. The lock bar 140 can thus be moved between a closed position and an open position. In the closed position, the lock bar 140 is displaced such that the hooks 142, 144 are engaged with engagement elements of the cover 300 that are complementary to the hooks 142, 144. In this way, it is achieved that the cover 300 cannot be pivoted about the longitudinal axis of the pin 312 when the engagement elements of the cover 300 and the hooks 142, 144 of the base 100 are engaged.

Each storage compartment 130*a* to 130*c* comprises a storage area 160*a* to 160*c* for receiving the notes of value to be received in the respective storage compartment 130*a* to 130*c*. Each of the storage areas 160*a* to 160*c* is delimited by a part of the first side wall 132, a part of the second side wall 134, a part of the bottom plate 162, a press-on wall 164*a* to 164*c* mounted movably in the stacking direction of the notes of value and a fixed wall 166*a* to 166*c*. The stacking direction is the direction in which the notes of value are stacked when they are placed in the respective storage area 160*a* to 160*c*. The stacking direction is in particular directed opposite to the transport direction P1. The fixed wall 166*a* to 166*c* is also referred to as stationary wall 166*a* to 166*c*. Preferably, between 100 and 200 notes of value are receivable in each storage area 160*a* to 160*c*.

The first press-on wall 164*a* of the first storage area 160*a* is mounted movably in the stacking direction by means of a first gear wheel 168*a*, a second gear wheel 170*a*, a first roll 172*a*, a second roll 174*a*, a third roll 176*a* and a fourth roll 178*a*.

The first gear wheel 168*a* and the first roll 172*a* are arranged at a first end of a shaft 180 rotatably mounted on the side of the press-on wall 164*a* facing away from the storage area 160*a* and are connected to this shaft in a rotationally fixed manner. The second gear wheel 170*a* and the second roll 174*a* are connected in a rotationally fixed manner to the second end of the shaft 180*a* that is opposite to the first end.

The first gear wheel 168*a* is engaged with a first toothing 182*a* of the first side wall 132, whereas the second gear wheel 170*a* is engaged with a first toothing 184*a* of the second side wall 134. The first roll 172*a* is guided in a first slot 186*a* of the first side wall 132 and the second roll 174*a* is guided in a first slot 188*a* of the second side wall 134. The gear wheels 168*a*, 170*a* and the rolls 172*a*, 174*a* are dimensioned such that the gear wheels 168*a*, 170*a* are indeed engaged with the respective toothing 182*a*, 184*a* but do not directly rest on the respective toothing 182*a*, 184*a*. In this way, the friction between the gear wheels 168*a*, 170*a* and the toothing 182*a*, 184*a* is reduced so that the press-on wall 164*a* can be displaced more easily in the stacking direction. The third roll 176*a* is guided in a second slot 190*a* of the first side wall 132 and the fourth gear wheel 178*a* is guided in a second slot 192*a* of the second side wall 134.

The third roll 176*a* is arranged offset relative to the press-on wall 164*a* in the direction of the storage area 160*a* via a first spacer 194*a* and the fourth roll 178*a* is arranged offset relative to the press-on wall 164*a* in the direction of the storage area 160*a* via a second spacer 196*a*. In this way, it is guaranteed that the press-on wall 164*a* keeps its orientation also during displacement in the stacking direction. In particular, it is achieved in this way that the press-on wall 164*a* remains substantially vertically. Further, by arranging the rolls 176*a*, 178*a* and the spacers 194*a*, 196*a* outside the storage area 160*a* a storage volume of the storage area 160*a* that is as large as possible is achieved. The press-on wall 164*a* is in particular mounted such that it does not contact the side of the bottom plate 162 facing the storage area 164*a*. Thus, any friction between the bottom plate 162 and the press-on wall 164*a* is prevented so that the press-on wall 164*a* can be displaced more easily in the stacking direction.

The press-on wall 164*a* is held in the unfilled state via an elastic element 198*a* such that the second roll 174*a* contacts a stop 200*a* that is firmly connected to the second side wall 134. In this position, the press-on wall 164*a* is spaced to the fixed wall 166*a* so that between the press-on wall 164*a* and the fixed wall 166*a* a supply opening for supplying the notes of value is formed. The elastic element 198*a* is in particular a spring, preferably a tension spring having a flat characteristic curve.

When a note of value is diverted from the transport path with the aid of the sorting gate 700*a* and supplied to the first storage area 160*a*, then the supplied note of value is pressed by means of vanes of vane wheels 540 to 548, 640 to 648 against the press-on wall 164*a* or, respectively, against a value note stack of notes of value already received in the first storage area 160*a*. The supplied note of value, the value note stack and the press-on wall 164*a* are hereby displaced in the stacking direction opposite to the force of the elastic element 198*a* so that the storage area 160*a* is enlarged in a stepwise or continuous manner in accordance with the number of notes of value received in the storage area 160*a*. In this way, an orderly stacking of the notes of value is guaranteed as by the continuous pressing of the notes of value of the value note stack against the press-on wall 164*a* a tipping over of the notes of value of the value note stack opposite to the stacking direction is prevented. By using a spring having a flat characteristic curve as an elastic element 198*a* it is achieved that the press-on wall 164*a* can easily be displaced in the stacking direction. The fixed wall 166*a* is firmly connected to both the first side wall 132 and the second side wall 134.

A note of value to be supplied to the first storage compartment 130*a* is deflected by means of the first sorting gate 700*a* by at least 90°, preferably by more than 90° when the note of value is diverted from the transport path so that, as a result of its internal stress, it rests against the side of the fixed wall 166*a* facing the first storage area 160*a* when it is supplied to the first storage area 160*a*. In this way, it is guaranteed that the front edge of the note of value to be supplied, as viewed in the supply direction, does not get jammed or get caught with the notes of value of the value note stack already contained in the storage area 160*a*, which would result in a value note jam. The fixed wall 166*a* comprises two recesses 202*a*, 204*a*, through each of which a roll 206*a*, 208*c* projects into the storage area 160*a*. The rolls 206*a*, 208*a* contact the note of value to be supplied to the storage area 160*a* when the note of value is supplied. In this way, the friction between the note of value and the fixed wall 166*a* is reduced so that an orderly stacking of the notes of value in the storage area 160*a* is guaranteed. Alternatively, only one recess 202*a*, 204*a* and, accordingly, only one roll 206*a*, 208*a* or more than two recesses 202*a*, 204*a* and, accordingly, more than two rolls 206*a*, 208*a* can be provided. Via a respective axis 210*a*, 212*a*, the rolls 206*a*, 206*b* are rotatably mounted in bearings 214*a*, 216*a*, 218*a*, 220*a* arranged on the side of the fixed wall 166*a* facing away from the storage area 160*a*.

Further, the fixed wall 166*a* has three further recesses 222*a*, 224*a*, 226*a*, through each of which a part of a spacer 228*a*, 230*a*, 232*a* projects into the storage area 160*a*. By means of the spacers 228*a*, 230*a*, 232*a*, notes of value whose short side falls below a minimum length are kept at a distance to the bottom plate 162 so that the upper edges of these notes of value can be contacted by the vanes of the vane wheels 540 to 548, 640 to 648 and can thus be pressed against the value note stack already contained in the storage area 160*a* or, respectively, against the press-on wall 164*a*. The spacers 228*a*, 230*a*, 232*a* are pivotally mounted by means of a respective axis 234*a*, 236*a*, 238*a* in a respective bearing element 240*a*, 242*a*, 244*a* arranged on the side of the fixed wall 166*a* facing away from the storage area 160*a*. Further, the spacers 228*a*, 230*a*, 232*a* are connected to the fixed wall 166*a* via a respective elastic element 246*a*, 248*a*, 250*a*, preferably via a respective spring, the elastic elements 246*a*, 248*a*, 250*a* being arranged at the side of the fixed wall 166*a* facing away from the storage area 160*a*. By means of the elastic elements 246*a*, 248*a*, 250*a* the spacers 228*a*, 230*a*, 232*a* are kept in an upper position in which the notes of value whose short sides fall below the minimum length are held such that they are arranged within the radius of the outer vane ends of the vane wheels 540 to 548, 640 to 648.

When a note of value whose short sides are longer than the minimum length is supplied to the storage area 160*a*, then the spacers 228*a*, 230*a*, 232*a* are pivoted opposite to the forces of the elastic elements 246*a*, 248*a*, 250*a* in the direction of the fixed wall 166*a* until they are arranged in the recesses 222*a*, 224*a*, 226*a*. In this way, it is achieved that, independent of their dimensions, the notes of value are always arranged such that they can be contacted by the vanes of the vane wheels 540 to 548, 640 to 648. Further, by mounting the spacers 228*a*, 230*a*, 232*a* by means of the elastic elements 246*a*, 248*a*, 250*a* it is achieved that the spacers 228*a*, 230*a*, 232*a* are pressed into the respective recesses 222*a*, 224*a*, 226*a* when the storage area 160*a* has reached its maximum filling volume. In this way, it is guaranteed that the entire volume of the storage area 160*a* can be utilized.

The second storage compartment 130*b* and the third storage compartment 130*c* are designed analogously to the previously described first storage compartment 130*a*. The reference signs of the corresponding elements have the same number but the respective letter b or C.

Figure 6:
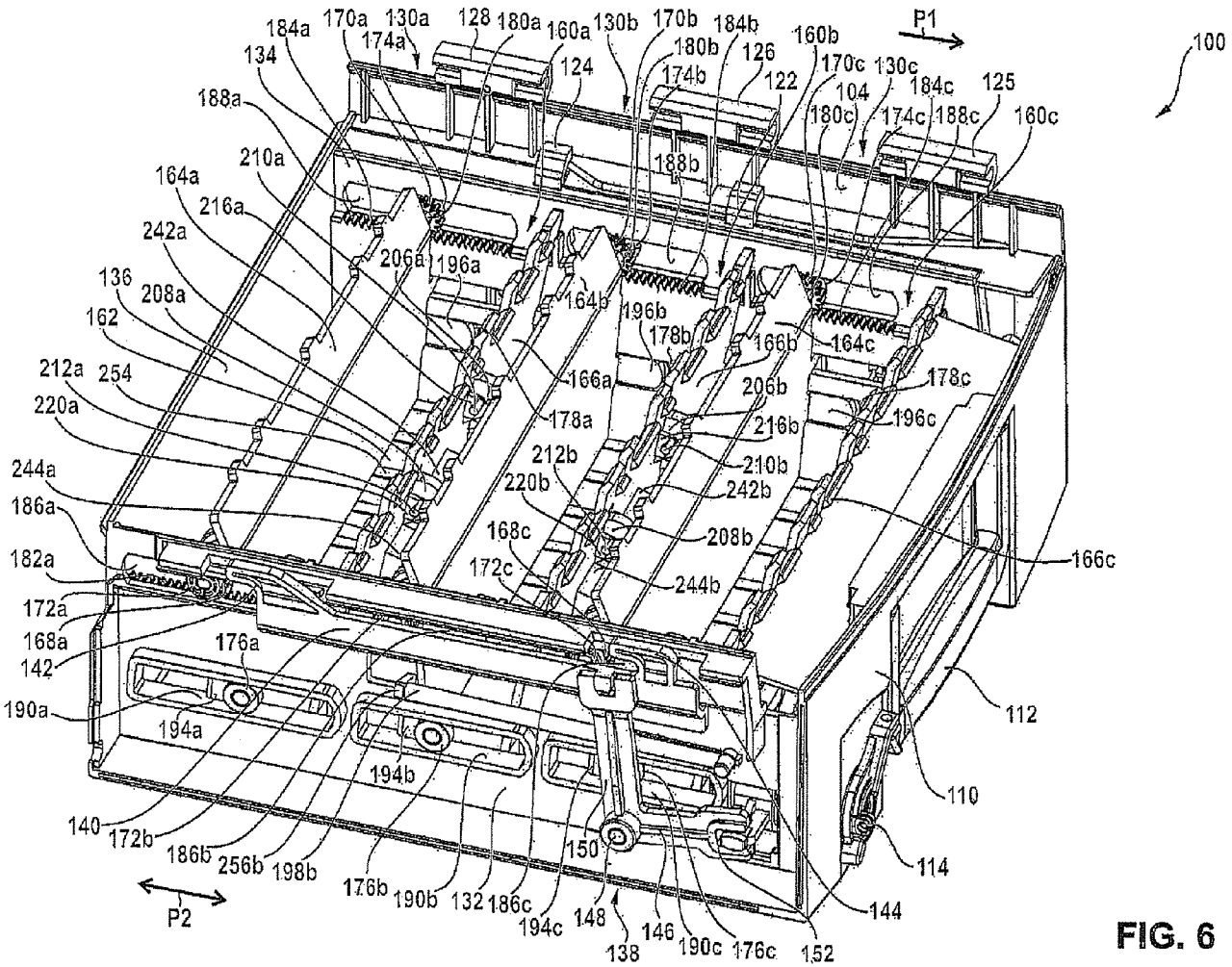
FIG. 6 shows a schematic perspective illustration of the base according to FIG. 5 in a partially filled state with a locking mechanism.

In FIG. 6, a schematic perspective illustration of the base 100 in a partially filled state is shown, with a view onto the first side wall 132. In the partially filled state, notes of value are already contained in the storage areas 160*a* to 160*c* of the storage compartments 130*a* to 130*c* but the storage compartments 130*a* to 130*c* are not filled to their maximum yet. Compared to the unfilled state shown in FIG. 5, the press-on walls 164*a* to 164*c* are displaced in the stacking direction. The notes of value received in the storage areas 160*a* to 160*c* are not illustrated in FIG. 6.

Figure 7:
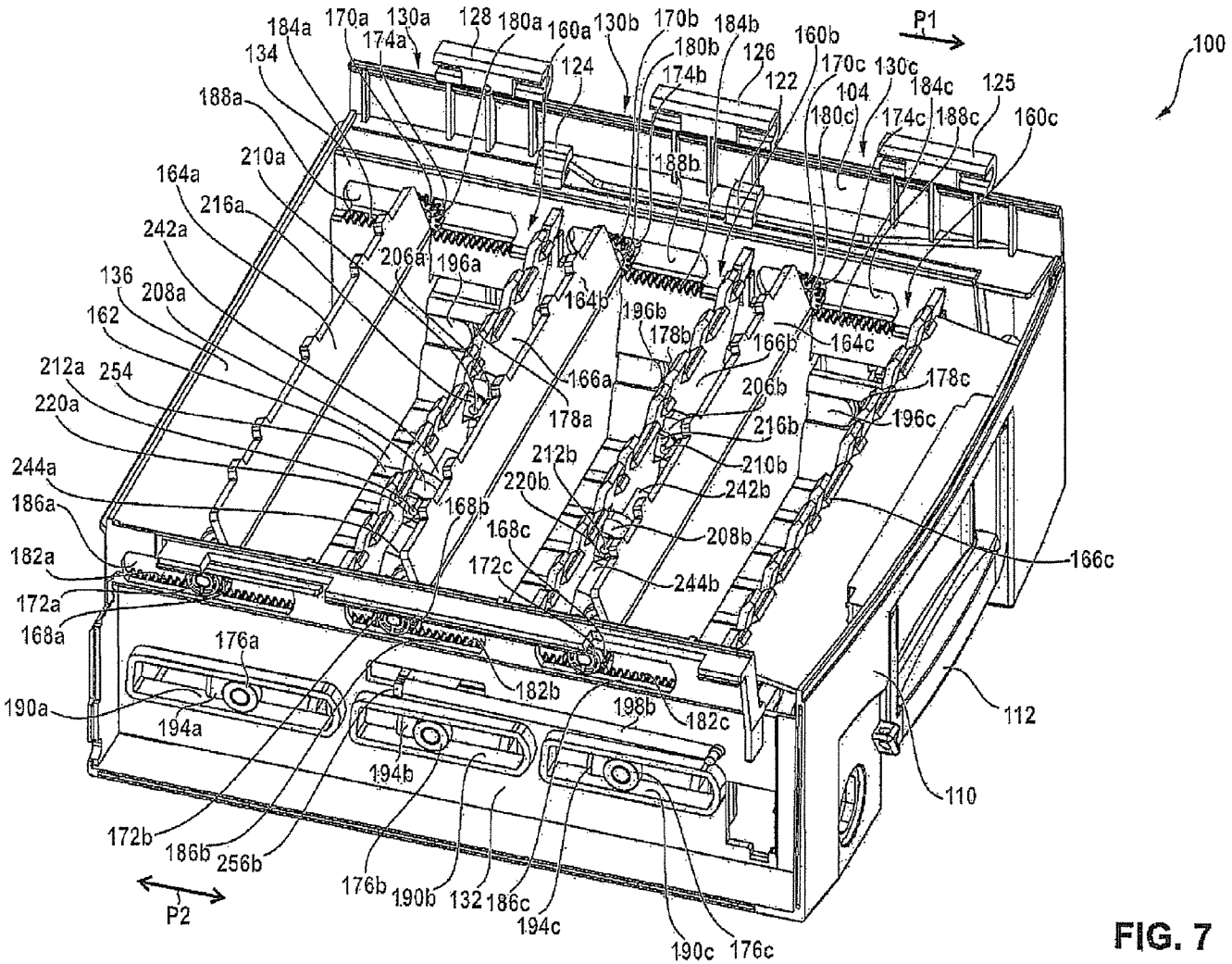
FIG. 7 shows a schematic perspective illustration of the base according to FIGS. 5 and 6 in the partially filled state without a locking mechanism.

In FIG. 7, a schematic perspective illustration of the base 100 in the partially filled state is shown, with a view onto the first side wall 132. The locking mechanism 138 is not illustrated in FIG. 7 so that the mountings of the press-on walls 164*a* to 164*c* in the first side wall 132 are better visible.

Figure 8:
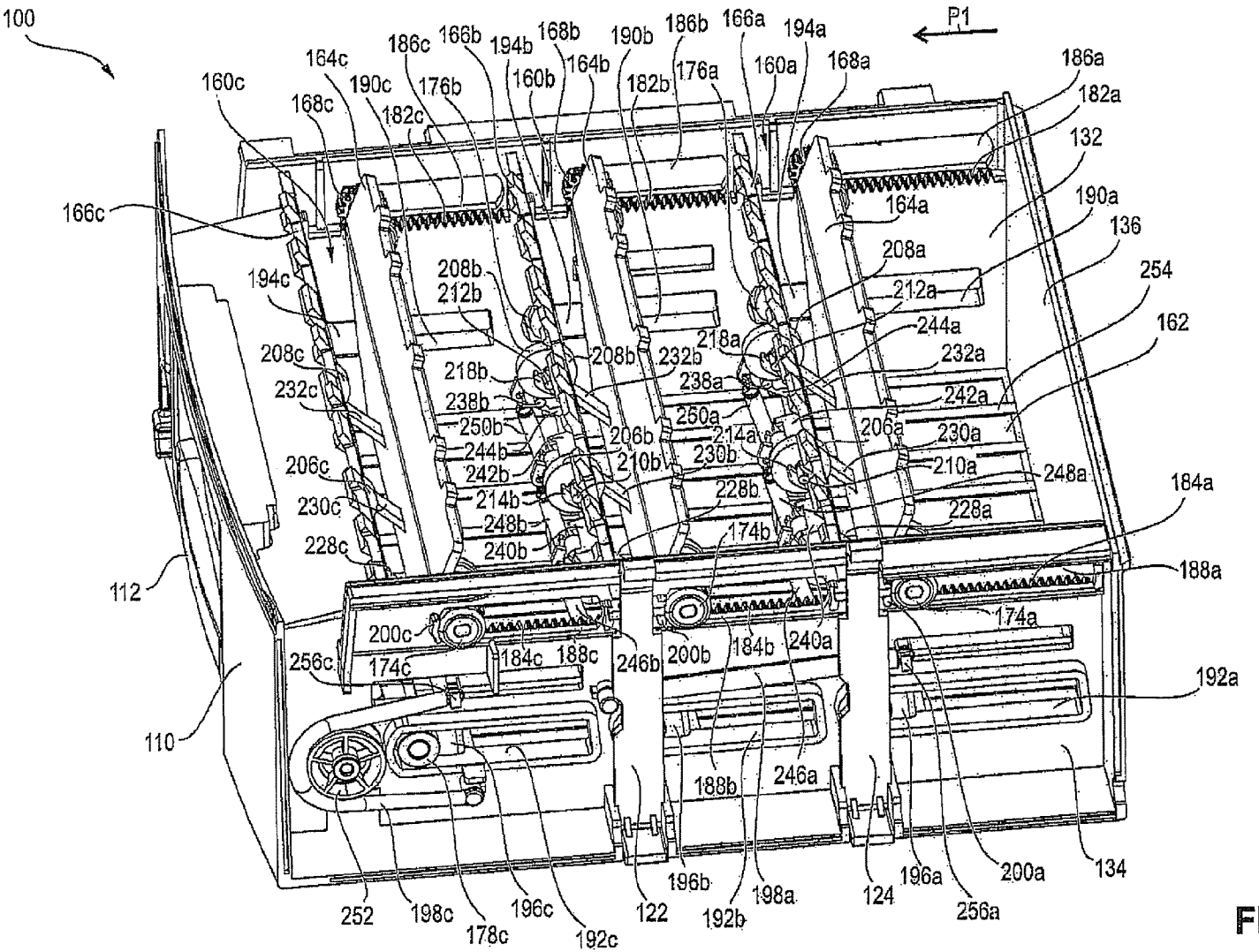
FIG. 8 shows a schematic perspective illustration of the base according to FIGS. 5 to 7 in the unfilled state, with a view onto a second side wall.
Figure 9:
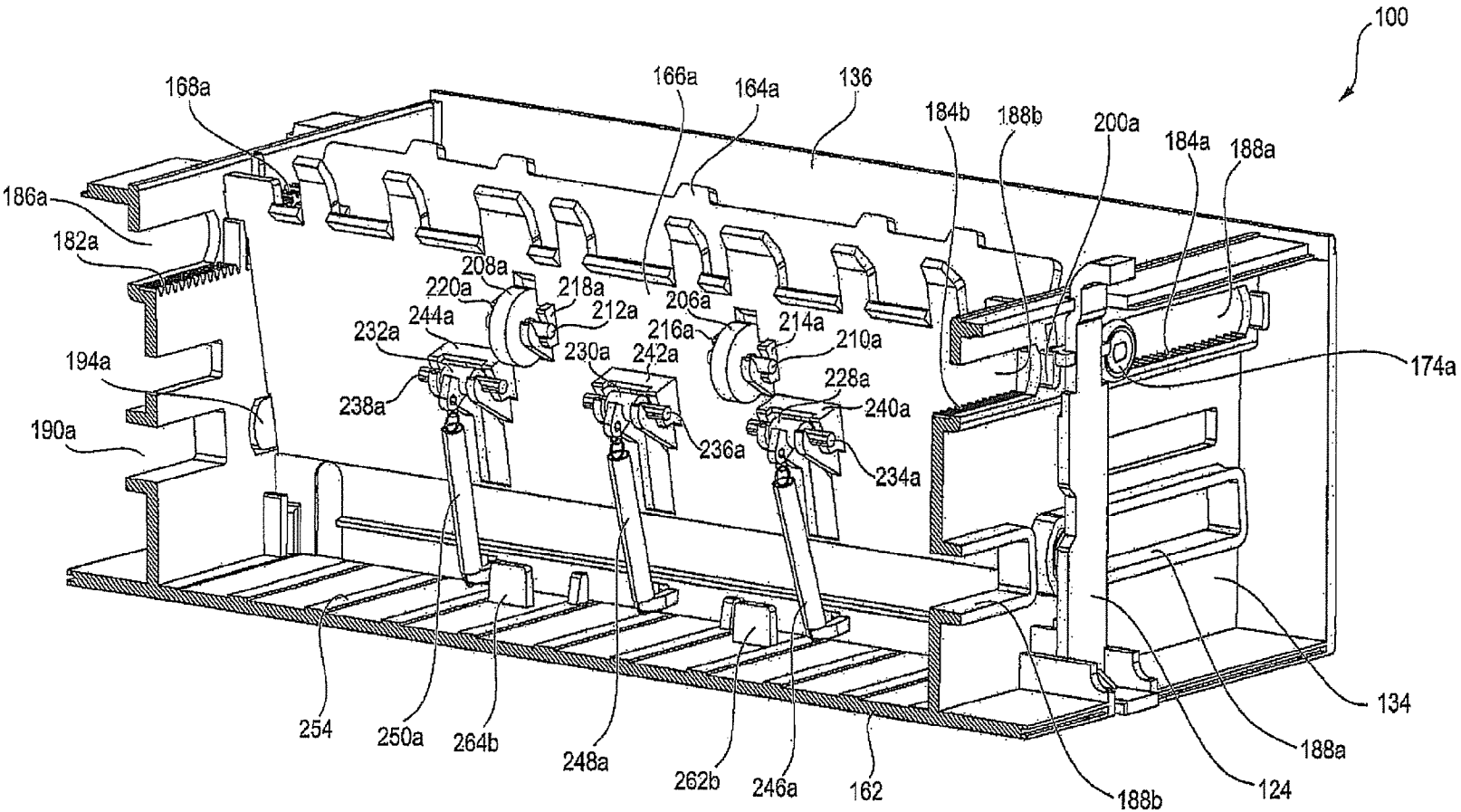
FIG. 9 shows a schematic perspective illustration of a cross-section of the base according to FIGS. 5 to 8.

In FIG. 8, a schematic perspective illustration of the base 100 in the unfilled state is shown, with a view onto the second side wall 134. In FIG. 9, the second side element 104 is not illustrated so that the component parts present in the space formed between the second side element 104 and the second side wall 134 are visible. The elastic element 198*c* via which the third press-on wall 166*c* is connected to the second side wall 134 is deflected by a roll 252 by about 90°. In this way, it is achieved that the elastic elements 198*a* to 198*c* are the same despite of the limited installation space and the press-on walls 166*a* to 166*c* have to be displaced opposite to the same amount of force generated by the elastic elements 198*a* to 198*c*.

In FIG. 9, a schematic perspective illustration of a cross-section of the base 100 according to FIGS. 5 to 8 is shown. On the side of the bottom plate 162 facing the storage areas 160*a* to 160*c*, several ribs extending in the stacking direction are arranged. One of these ribs is exemplarily identified with the reference sign 254. Two adjacent ribs 254 preferably have the same distance to each other each time. The ribs 254 are preferably polished. In this way, it is achieved that the friction between the notes of value received in the storage areas 160*a* to 160*c* and the bottom plate 162 is reduced so that the notes of value of the value note stack can be displaced more easily in the stacking direction.

Figure 10:
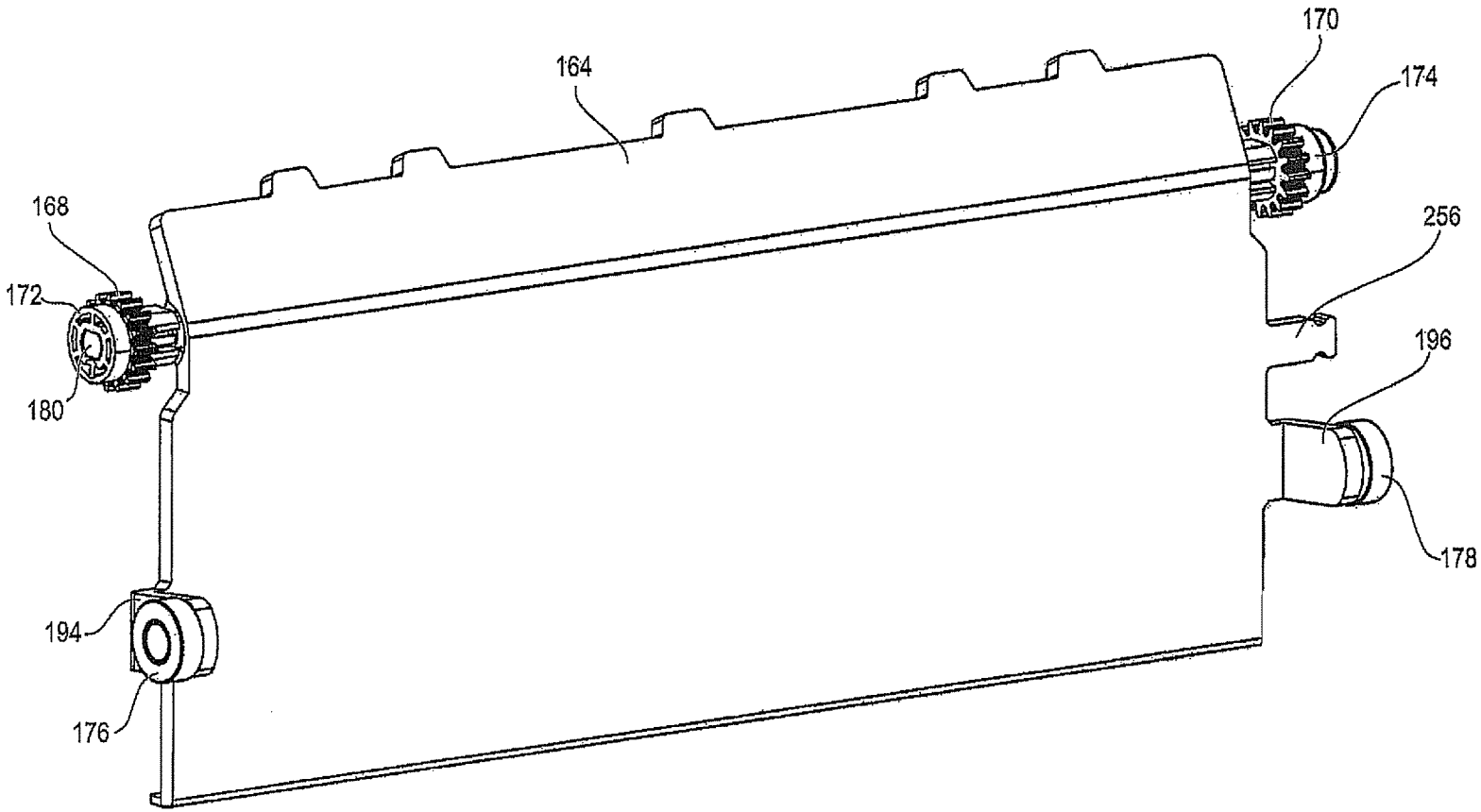
FIG. 10 shows a schematic perspective illustration of a press-on wall of the base, with a view onto the side facing the storage area.
Figure 11:
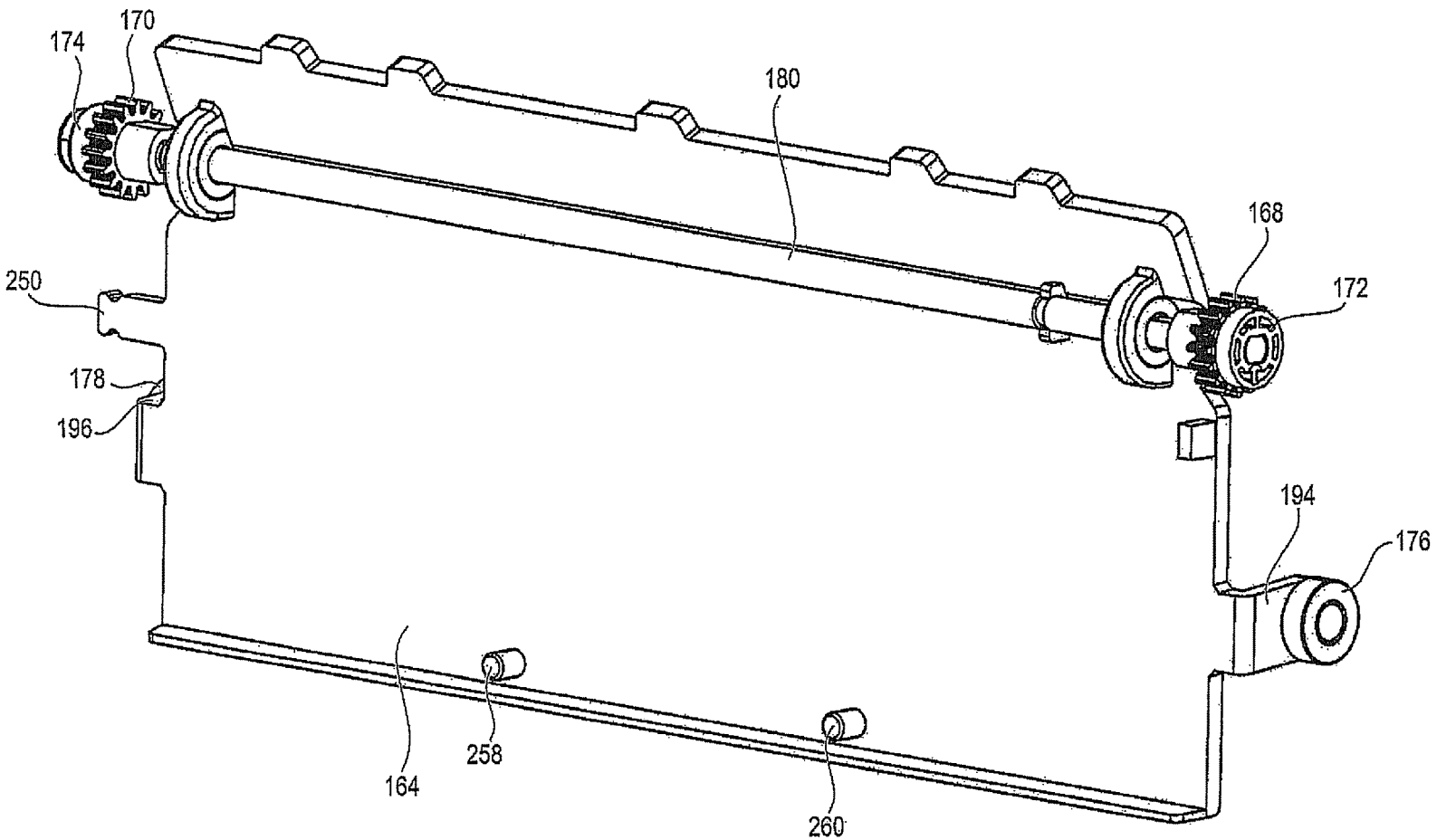
FIG. 11 shows a schematic perspective illustration of the press-on wall according to FIG. 10, with a view onto the side facing away from the storage area.

In FIG. 10, a schematic perspective illustration of a press-on wall 164 is shown, with a view onto the side facing the storage area 160 which is delimited by the press-on wall 164. In FIG. 11, a schematic perspective illustration of the press-on wall 164 according to FIG. 10 is illustrated, with a view onto the side facing away from the storage area 160. The press-on wall 164 corresponds to the press-on walls 164*a* to 164*c* according to FIGS. 5 to 9. Just for increasing the clarity, the individual elements are identified with the respective reference sign without a letter. The press-on wall 164 comprises a projection 256 which is engaged with the elastic element 198, via which the press-on wall 164 is connected to the first side wall 132 or the second side wall 134. On the side of the press-on wall 164 facing away from the storage area 160 two stoppers 258, 260 are arranged, each of which presses against a counter-pressure element 262*b*, 264*b*, that is firmly connected to the bottom plate 162, when the press-on wall 164 is displaced maximally in the stacking direction. In this way, it is prevented that the press-on wall 164 is pressed against the fixed wall 166*a* to 166*c* delimiting the adjacent storage area 160*a* to 160*c* or, respectively, against the front wall 136 of the base 100. An upper area of the press-on wall 164 is preferably bent away from the storage area 160. This increases the supply opening. Further, a press-on wall 164 is designed as flat as possible to achieve a receiving volume of the storage area 160 that is as large as possible.

Figure 12:
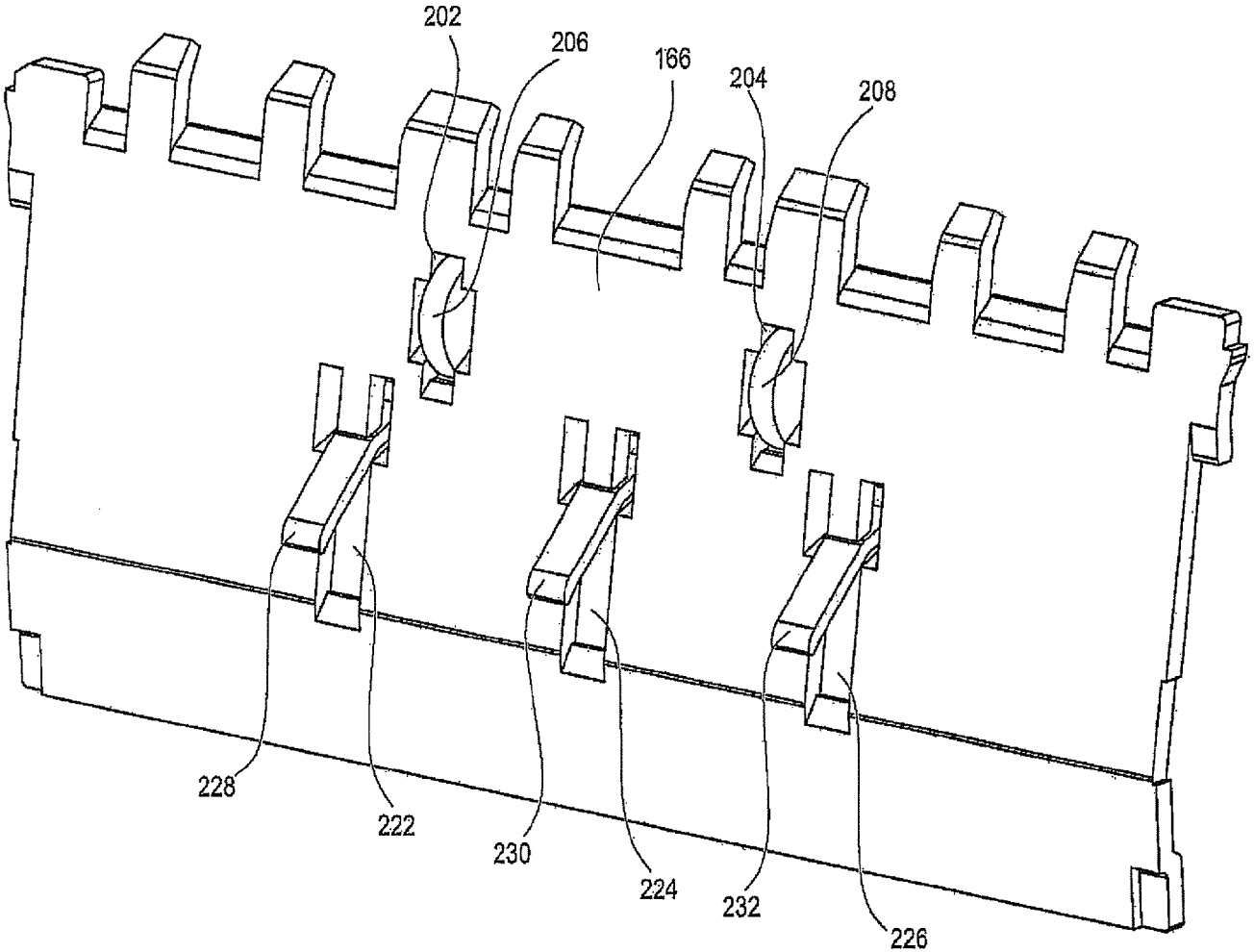
FIG. 12 shows a schematic perspective illustration of a fixed wall, with a view onto the side facing the storage area.
Figure 13:
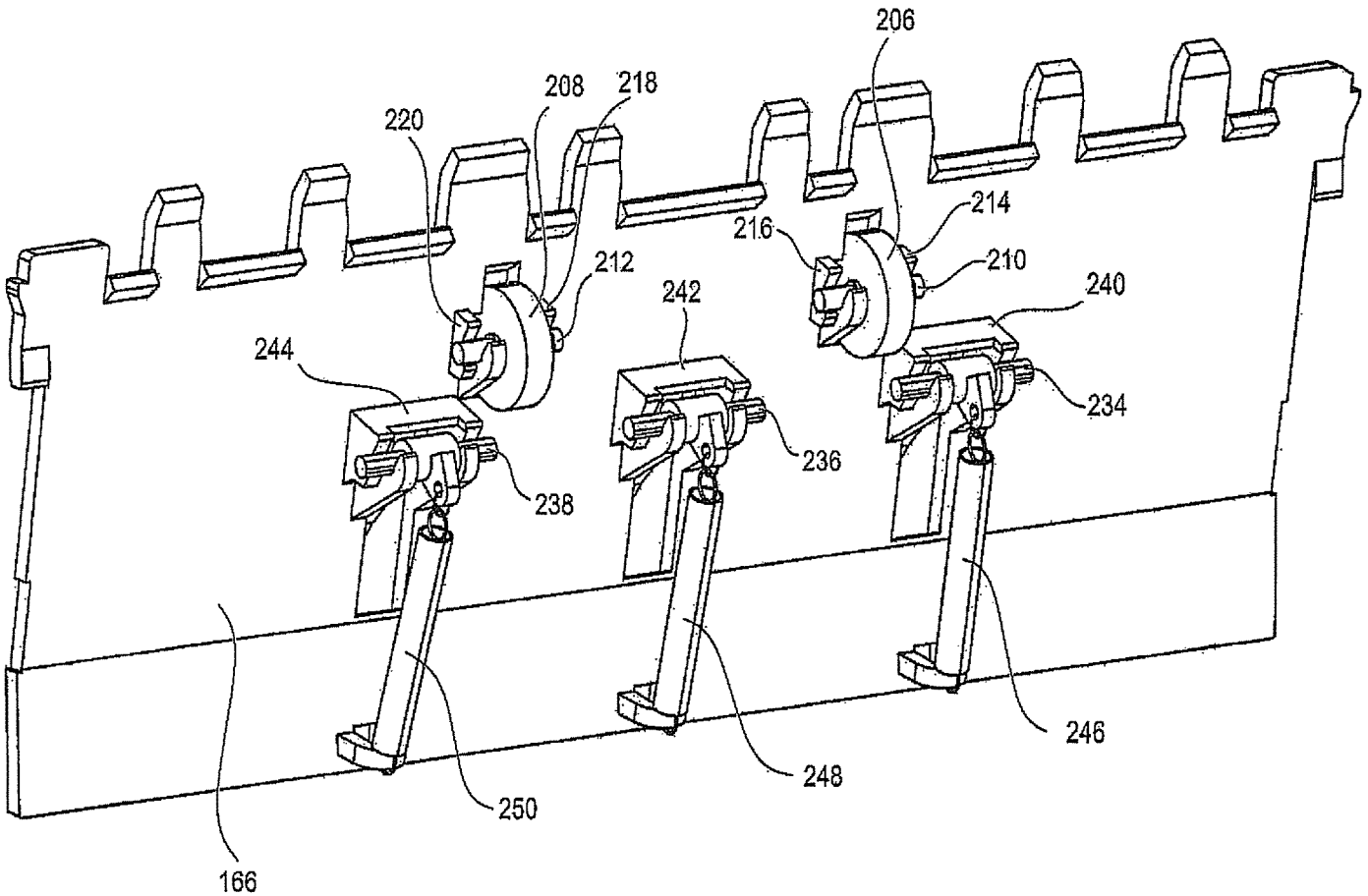
FIG. 13 shows a schematic perspective illustration of the fixed wall according to FIG. 12, with a view onto the side facing away from the storage area.

In FIG. 12, a schematic perspective illustration of a fixed wall 166 is shown, with a view onto the side of the fixed wall 166 facing the storage area 160. In FIG. 13, a schematic perspective illustration of the fixed wall 166 according to FIG. 12 is shown, with a view onto the side facing away from the storage area 160. The fixed wall 166 shown in FIGS. 12 and 13 corresponds to the fixed walls 166*a* to 166*c* shown in FIGS. 5 to 9. Just for increasing the clarity, the individual elements are identified only with the respective reference sign without a letter. The fixed wall 166 and the press-on wall 164 are arranged substantially parallel to each other.

Figure 14:
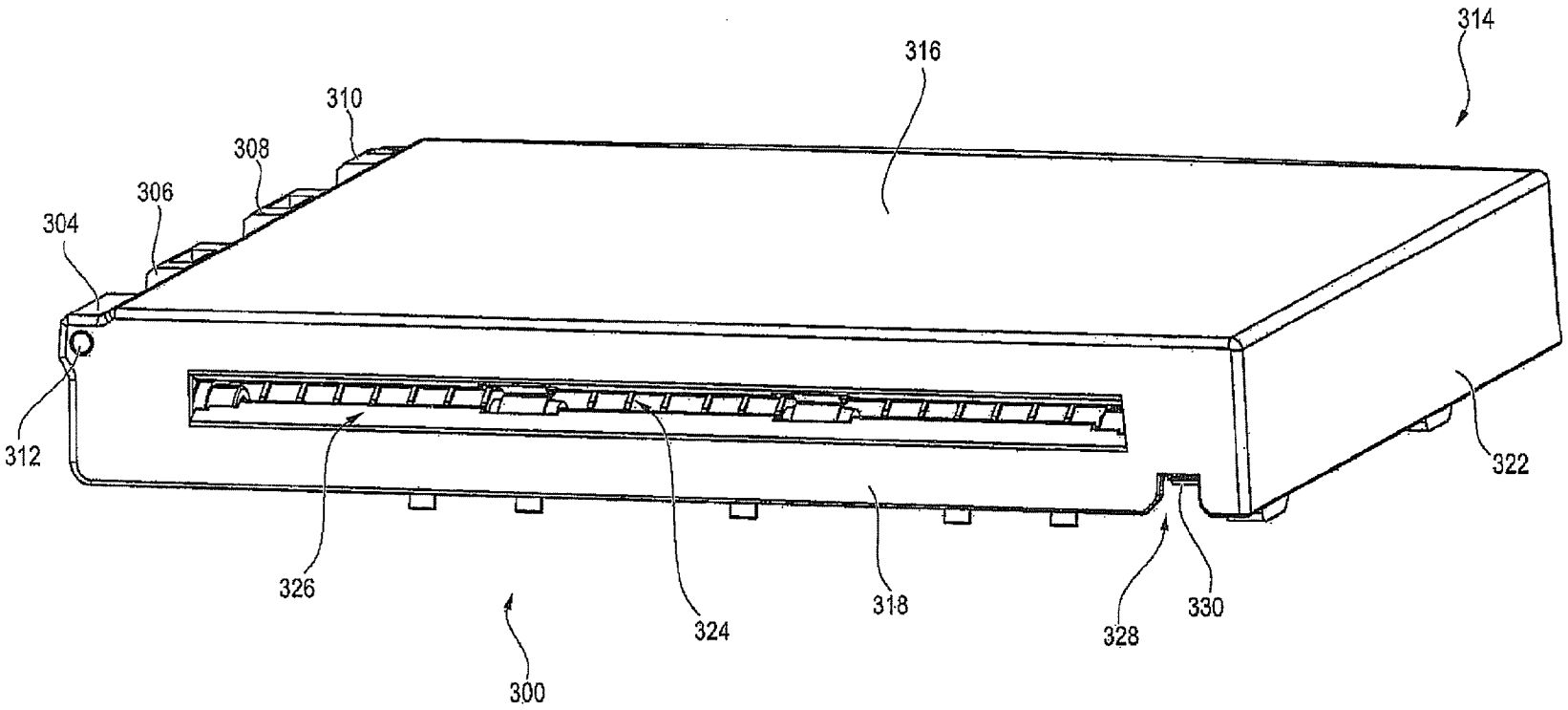
FIG. 14 shows a schematic perspective front-view illustration of a cover of the value note cassette according to FIGS. 1 to 4.

In FIG. 14, a schematic perspective illustration of the cover 300 is shown, with a view onto the front wall 318 of the housing 314 of the cover 300. The front wall 318 has a recess 328 through which a drive wheel 330 is engageable with a central drive of the automated teller machine in which the value note cassette 10 is received. The supply device 324 is driven by the drive wheel 330. In this way, it is achieved that the entire supply unit 324 of the value note cassette 10 is drivable via a drive unit arranged outside the value note cassette 10 and no drive unit has to be arranged within the value note cassette 10. In this way, installation space within the value note cassette 10 is saved, as a result whereof the storage areas 160*a* to 160*c* can be designed as large as possible.

Figure 15:
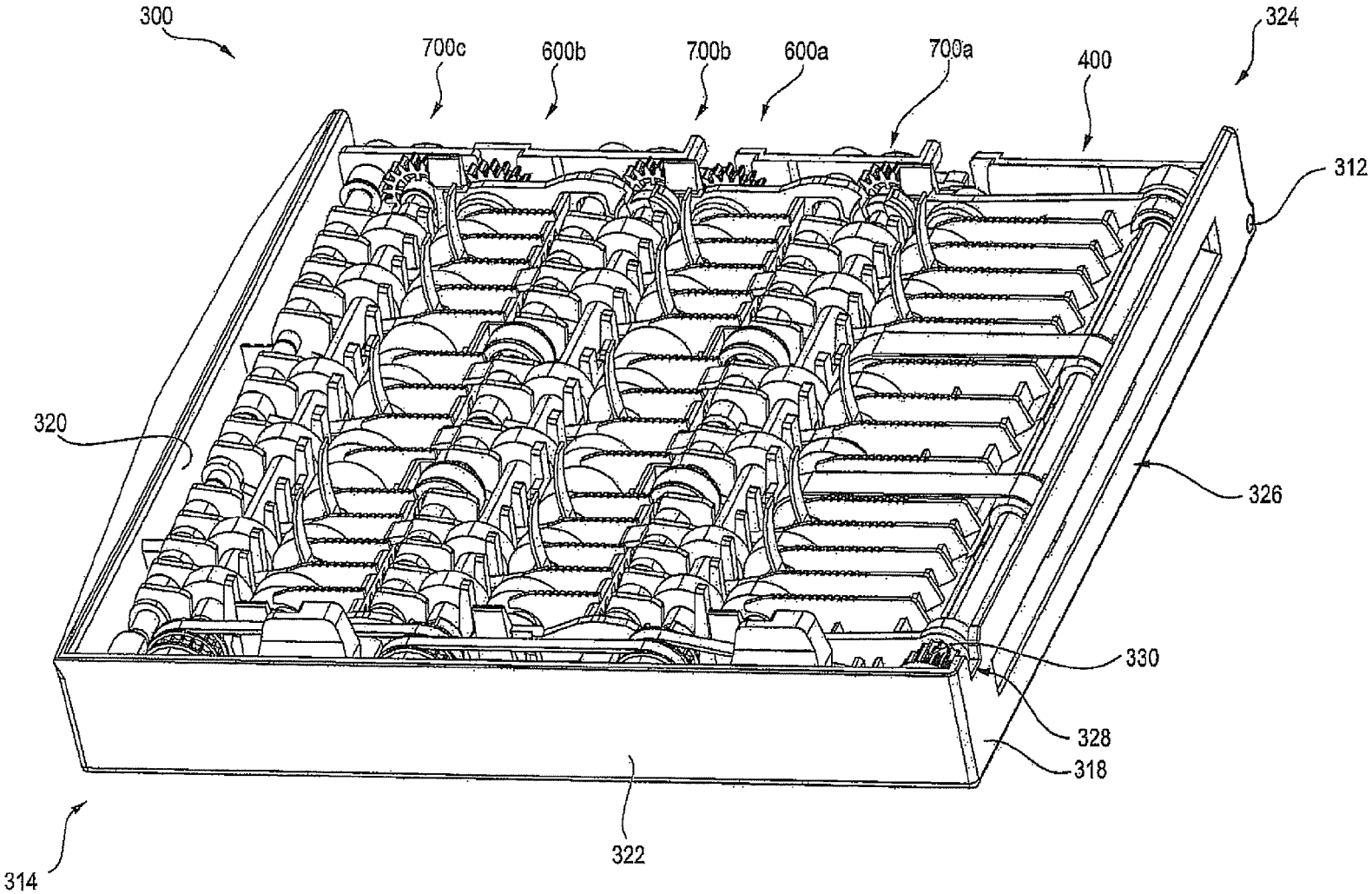
FIG. 15 shows a schematic perspective bottom-view illustration of the cover according to FIG. 14.
Figure 16:
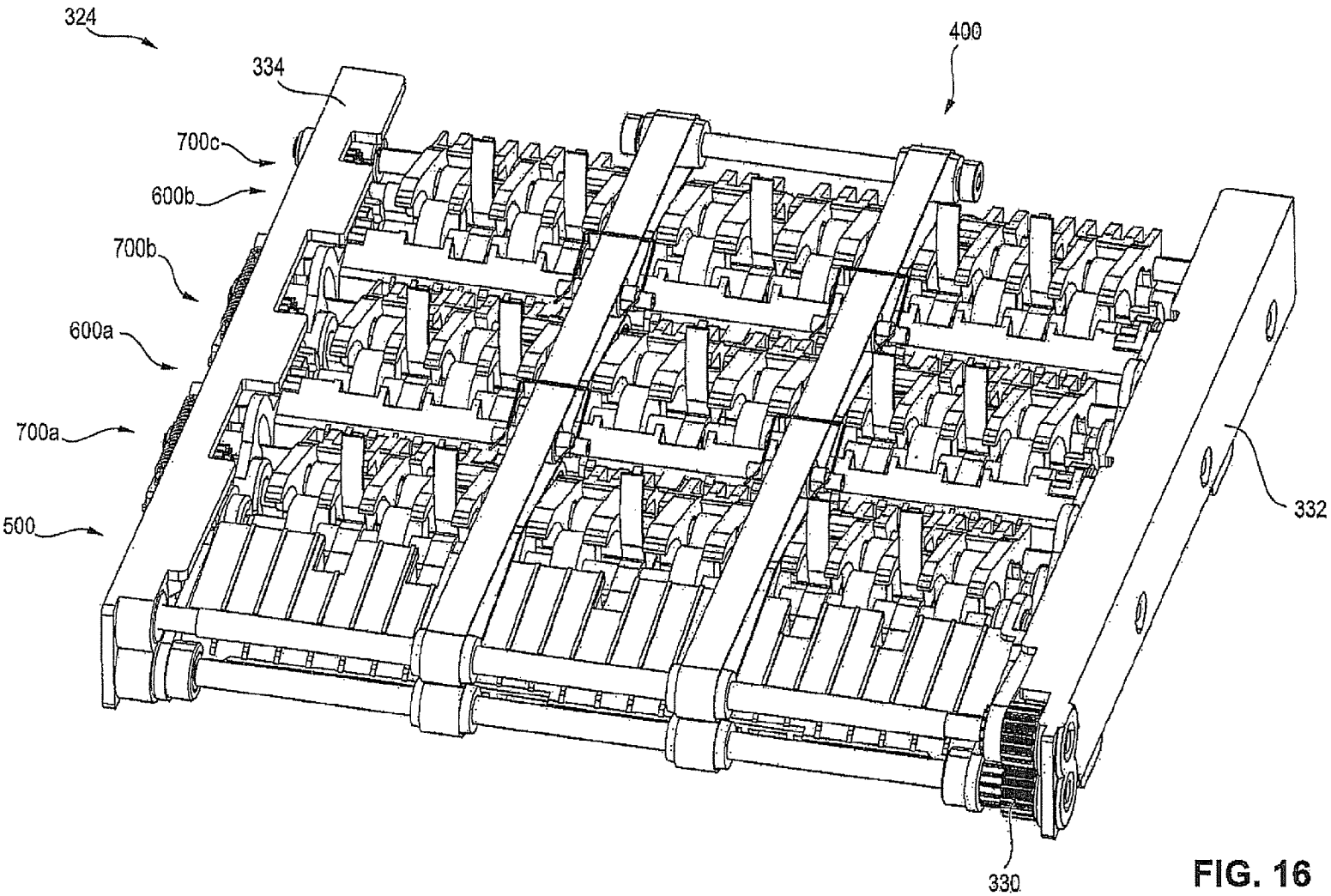
FIG. 16 shows a schematic perspective illustration of the cover according to FIGS. 14 and 15 without a housing of the cover.

In FIG. 15, a schematic perspective bottom-view illustration of the cover 300 is shown. In FIG. 16, a schematic perspective illustration of the supply unit 324 is shown. The supply unit 324 is laterally delimited by two rails 332, 334, the first rail 332 being firmly connected to the side wall 322 of the housing 314. Both the first side rail 332 and the second side rail 334 are likewise firmly connected to the upper wall 316 of the housing 314.

Figure 17:
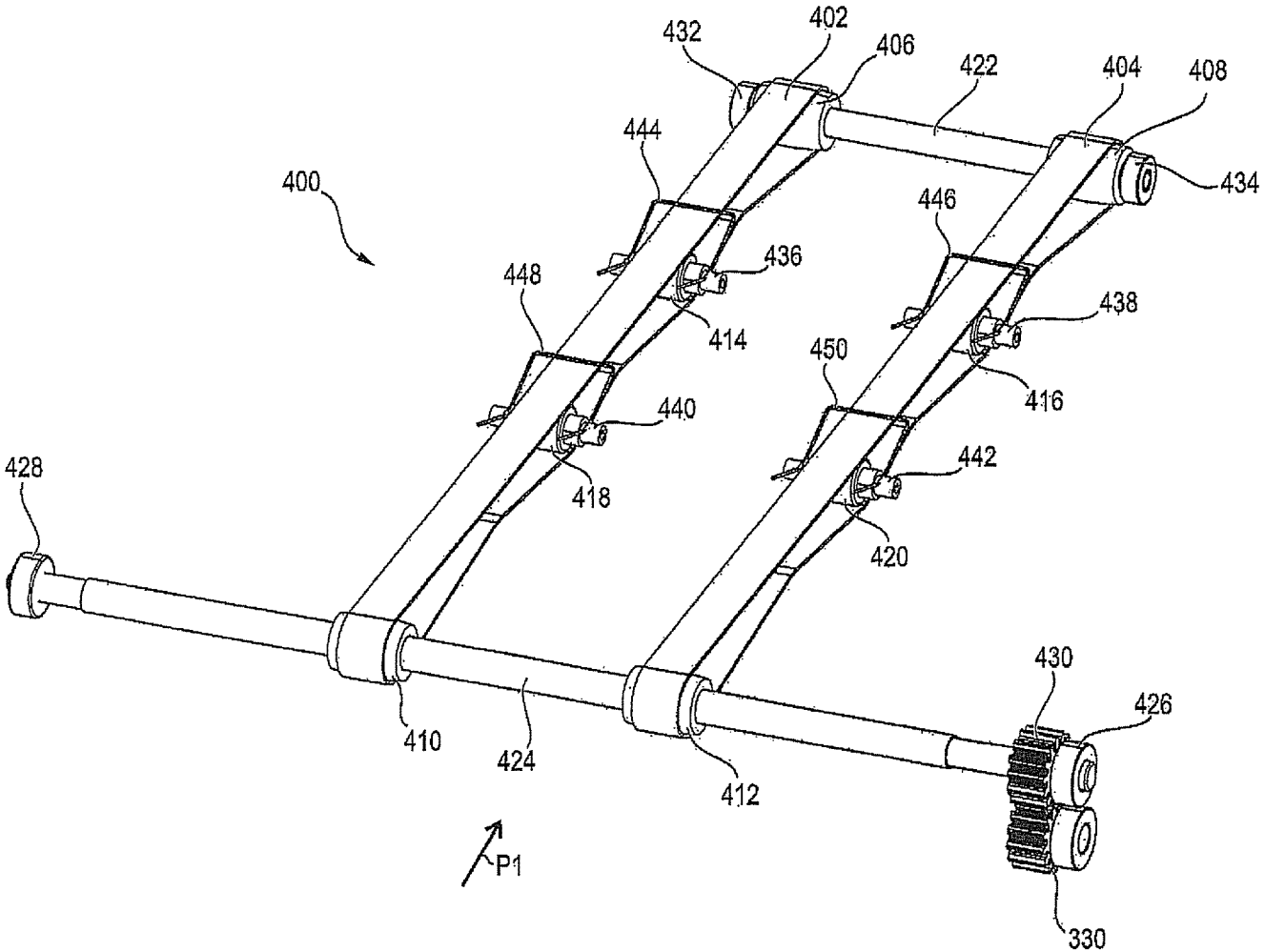
FIG. 17 shows a schematic perspective illustration of an upper transport of a supply unit of the cover.

In FIG. 17, a schematic perspective illustration of the upper transport unit 400 and the drive wheel 330 is shown. The upper transport unit 400 delimits the transport path towards the top, i.e. in the direction of the housing 314.

The upper transport unit 400 comprises two belts 402, 404, each of which is guided via four rolls 406 to 420. The side of the belts 402, 404 facing the base 100 contacts the notes of value to be transported and thus transports the notes of value along the transport path in the transport direction P1. The belts 402, 404 contact the surface of the notes of value to be transported that faces the upper wall 316 of the cover 300. The first roll 406 and the second roll 408 are arranged on a first shaft 422 and are connected thereto in a rotationally fixed manner. The third roll 410 and the fourth roll 414 are arranged on a second shaft 424 and are likewise connected thereto in a rotationally fixed manner. At both ends of the first shaft 422, a respective roll 432, 434 is arranged via which the first shaft 422 is rotatably connected to the housing 314. Likewise, at the ends of the second shaft 424, a respective roll 426, 428 is arranged by which the second shaft 424 is rotatably mounted to the side rails 332, 334. Further, on the second shaft 424 a gear wheel 430 is arranged and is connected to the shaft 424 in a rotationally fixed manner. The gear wheel 430 is engaged with the drive wheel 330 so that the shaft 424 is rotated by the drive wheel 330 upon a rotation of the drive wheel 330.

The rolls 414 to 420, too, are respectively arranged on a shaft 436 to 442. Each of the shafts 436 to 442 is connected via a respective spring element 444 to 450 to the housing 314 so as to be resilient transversely to the transport direction P1. By the rolls 414 to 420, the belts 402, 404 are guided in the area facing the transport path such that the course of the belts 402, 404 adapts in this area to the course of the transport path predetermined by the sorting gates 700*a* to 700*c*, the front-end transport unit 500 and the intermediate transport units 600*a*, 600*b*. By the resilient mounting of the rolls 414 to 420 by means of the spring elements 444 to 450, a proper transport of the notes of value along the transport path in the transport direction P1 is achieved independent of the position of the sorting gates 700*a*, 700*b*. In particular, by the resilient mounting, a value note jam and/or damage to the notes of value is prevented. In an alternative embodiment of the invention, also more than two belts 402, 404 can be provided. Likewise, in an alternative embodiment, only one belt 402, 404 can be provided. Further, the transport of the notes of value can take place by the direct contact with rolls or rollers instead of belts 402, 404.

Figure 18:
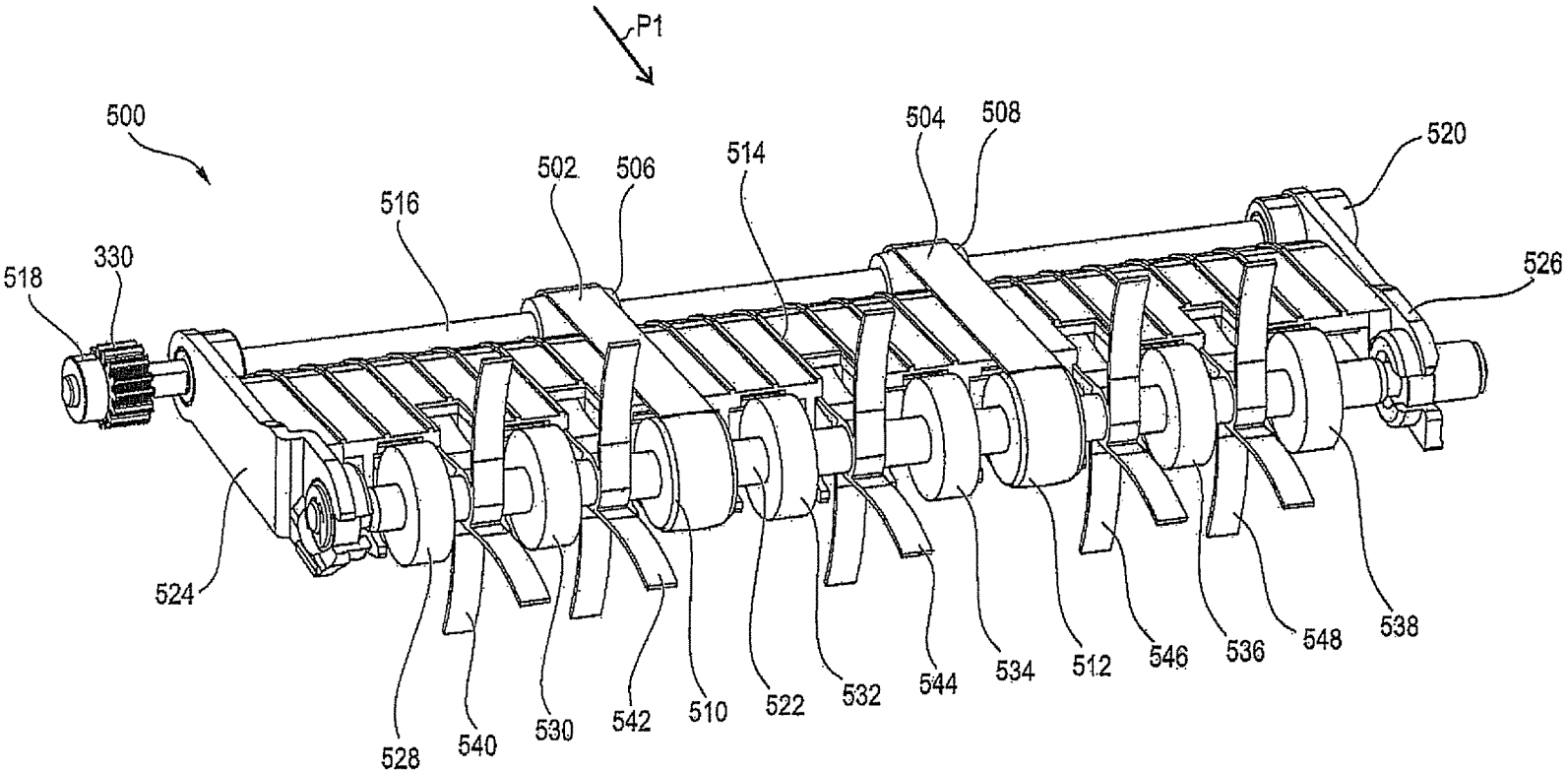
FIG. 18 shows a schematic perspective illustration of a front-end transport unit of the supply unit.

In FIG. 18, a schematic perspective illustration of the front-end transport unit 500 is shown. The front-end transport unit 500 comprises two belts 502, 504, each of which is guided over two rolls 506 to 512. The belts 502 to 504 contact the side of the notes of value facing the base during the transport of the notes of value in the transport direction P1 along the transport path. The first roll 506 and the second roll 508 are arranged on a first shaft 516 of the front-end transport unit 500 and are connected thereto in a rotationally fixed manner. Likewise, the drive wheel 330 is connected to the shaft 516 in a rotationally fixed manner. At both ends of the shaft 516, a respective roll 518, 520 is mounted, by which the first shaft 516 is rotatably mounted to the side rails 332, 334. The first shaft 516 can be rotated via the drive wheel 330.

The rolls 510, 512 are arranged on a second shaft 522 of the front-end transport unit 500 and connected thereto in a rotationally fixed manner. The first shaft 516 and the second shaft 522 are connected to each other via two connecting elements 524, 526. The shafts 516, 522 are respectively rotatably mounted in the connecting elements 524, 526.

Further, the front-end transport unit 500 comprises a support unit 514 which is arranged between the two shafts 516, 522. The support unit 514 serves to guide the notes of value during their transport along the transport path. In particular, the support unit 514 prevents that the notes of value get jammed and/or get caught with other components parts.

In an alternative embodiment, also more than two belts 502, 504 or only one belt 502, 504 can be provided. Alternatively or additionally, the transport of the notes of value can likewise take place by means of rolls and/or rollers.

On the second shaft 522, in addition six further rolls 528 to 538 are arranged and connected to the shaft 522 in a rotationally fixed manner. When the shaft 522 is rotated, the rolls 528 to 538 likewise rotate. The rolls 528 to 538 contact the notes of value transported along the transport path at least when the notes of value are not diverted from the transport path by the first sorting gate 700*a*. The rolls 528 to 538 thus likewise serve to transport the notes of value.

Further, five vane wheels 540 to 548 are arranged on the second shaft 522 and are likewise connected to the shaft 522 in a rotationally fixed manner. When the second shaft 522 is rotated, the vane wheels 540 to 548 rotate as well. The vane wheels 540 to 548 contact with their vanes the note of value supplied to the first storage compartment 130*a* as the last note of value. In this way, the vane wheels 540 to 548 exert a pressing force on the last note of value supplied to the first storage area 160*a* and thus press the note of value supplied as the last note of value and the value note stack already received in the storage area 160*a* against the first press-on wall 164*a* and thus displace the note of value supplied as the last note of value, the value note stack and the press-on wall in the stacking direction of the notes of value.

By pressing the value note stack against the press-on wall 164*a* by means of the vane wheels 540 to 548, a supply opening is formed between the value note stack already received in the storage area 160*a* and the fixed wall 166*a* so that a further note of value can be supplied to the first storage area 160*a*. This in particular reduces the risk that a note of value to be supplied gets caught on the notes of value of the value note stack.

Such a shaft 522 with the rolls 528 to 538 arranged thereon as well as the vane wheels 540 to 548 arranged thereon is analogously provided in the intermediate transport units 600*a*, 600*b*. The shafts 622 with the vane wheels 628 to 638 serve to press the value note stack received in the respective storage area 160*b*, 160*c* against the second press-on wall 164*b* or, respectively, against the third press-on wall 164*c*.

Figure 19:
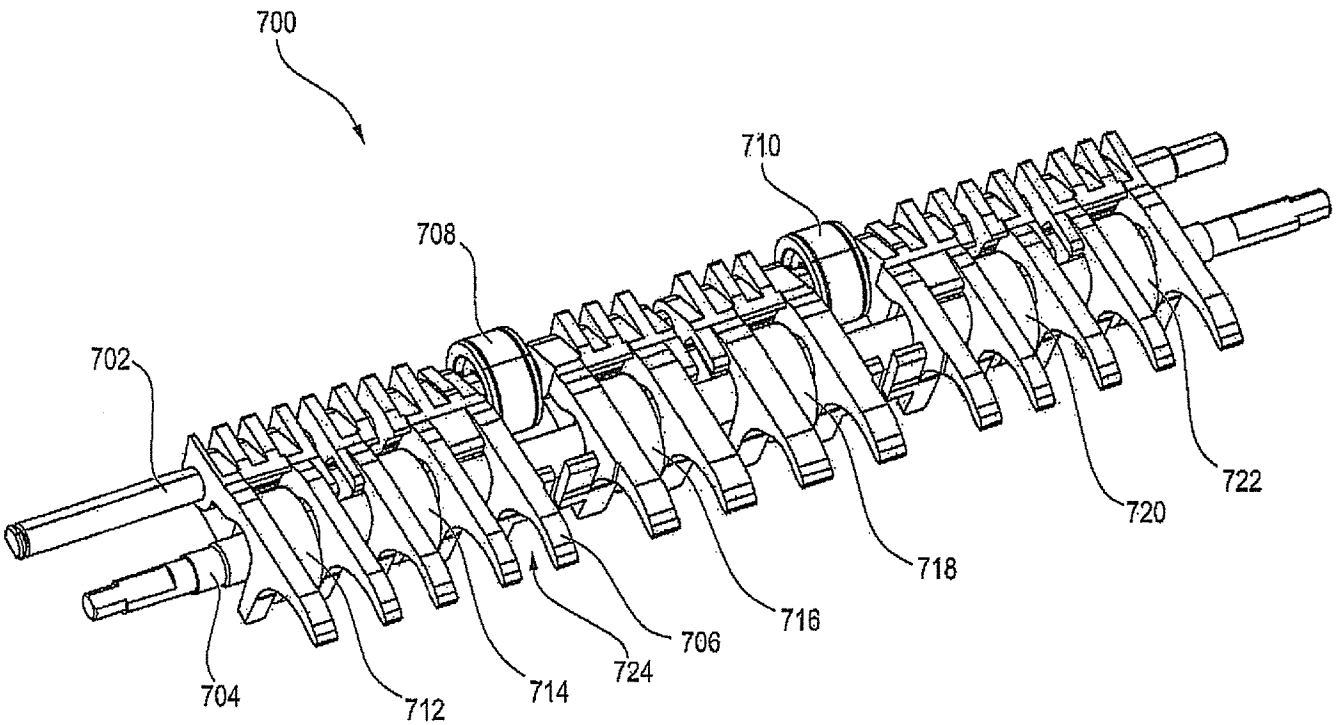
FIG. 19 shows a schematic perspective illustration of a sorting gate of the supply unit.

In FIG. 19, a schematic perspective illustration of a sorting gate 700 is shown. The sorting gates 700*a* to 700*c* are structured analogously to the sorting gate 700 already described in every detail. For simplification of the illustration, the sorting gate illustrated in FIG. 19 and its elements are respectively identified only with a reference sign without any letter. The elements of the three sorting gates 700*a* to 700*c* have the same reference sign numbers, supplemented by the letter corresponding to the respective sorting gate 700*a* to 700*c*.

The sorting gate 700 comprises a first shaft 702 and a second shaft 704. The shafts 702, 704 are arranged such that their longitudinal axes extend parallel to each other. On the first shaft 702, a plurality of fingers is arranged. One of these fingers is exemplarily identified with the reference sign 706. The fingers 706 are connected to the first shaft 702 in a rotationally fixed manner so that the fingers 706 are pivoted about their longitudinal axis when the first shaft 702 is rotated. The sorting gate 700 is in particular designed such that the fingers are pivotable between a lower position and a diverting position. In the lower position, the fingers 706 are arranged such that they do not project into the transport path and thus do not divert notes of value transported along the transport path into the storage area 160*a* to 160*c* to which the sorting gate 700*a* to 700*c* is allocated.

Compared to the lower position, the fingers 706 are pivoted upward such in the diverting position that at least a part of a contact area 724 of the fingers 706 projects into the transport path and thus diverts the notes of value transported along the transport path from the transport path and supplies them to the storage area 160*a* to 160*c* to which the sorting gate 700*a* to 700*c* is allocated. The contact area 724 of the fingers 706 is in particular bent by at least 90°, preferably by more than 90°, so that the diverted notes of value are deflected by at least 90° and thus, due to their internal stress, rest against the respective fixed wall 166*a* to 166*c*. In this way, it is prevented that a note of value and the value note stack already stacked in the storage area 160*a* to 160*c* get caught on each other. The fingers 706 are further designed such that independent of the position into which they are pivoted they do not contact the second axis 704.

Further, on the first shaft 702, two rolls 706 and 710 are arranged which are rotatably mounted on the shaft 702. The rolls 708, 710 contact the notes of value during the transport of the notes of value along the transport path and serve to guide the notes of value.

On the second shaft 704, altogether six rolls 712 to 722 are arranged, which are connected to the driven shaft 704 in a rotationally fixed manner. The shaft 704 is arranged such that the rolls 712 to 722 contact the rolls 528 to 538 of the second shaft 522 of the front-end transport unit 500 or, respectively, the respective rolls 628 to 638 of the intermediate transport unit 600*a*, 600*b* at least when no note of value is diverted from the transport path by means of the sorting gate 700. The shaft 704 and the shaft 522 are driven in opposite directions of rotation so that those notes of value that are diverted from the transport path by means of the sorting gate 700 are contacted by a contact with the pairs of rolls formed by the rolls 528 to 538 or, respectively, 628 to 638 and 712 to 722 and are transported into the storage area 160*a* to 160*c* to which the sorting gate 700*a* to 700*c* is allocated. The fingers 706 are arranged such that each of the vanes of the vane wheels 540 to 548, 640 to 648 can be moved through between two adjacent fingers 706 and thus the vanes of the vane wheels 540 to 548, 640 to 648 and the fingers 706 do not contact one another.

Figure 20:
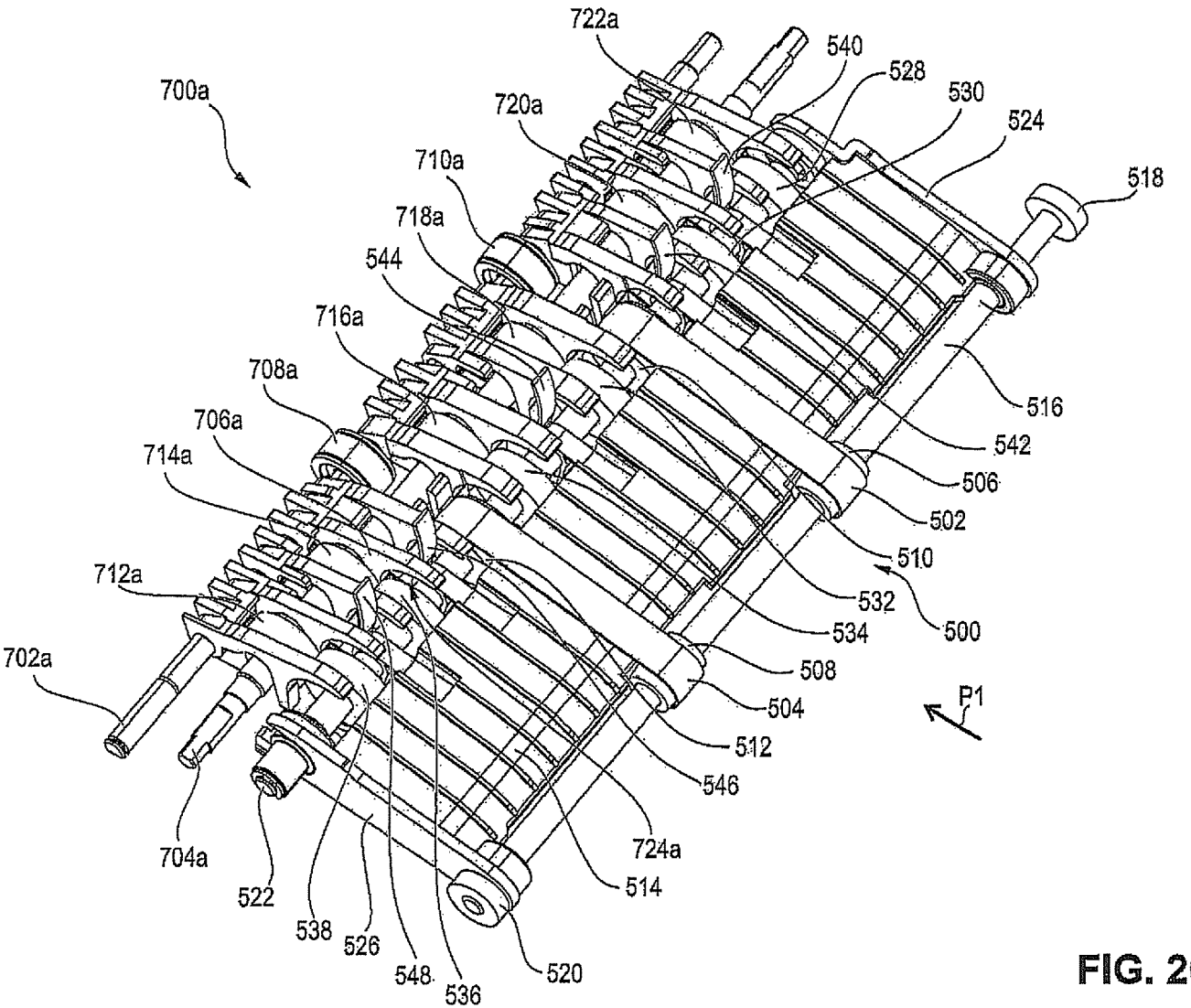
FIG. 20 shows a schematic perspective illustration of the sorting gate according to FIG. 19 and the front-end transport unit according to FIG. 18.

In FIG. 20, a schematic perspective illustration of the sorting gate 700*a* and the front-end transport unit 500 is shown. The fingers 706*a* of the sorting gate 700*a* are arranged in the diverting position so that a note of value transported in the transport direction P1 by means of the front-end transport unit 500 is diverted with the aid of the sorting gate 700*a* and is supplied to the first storage area 160*a*.

Figure 21:
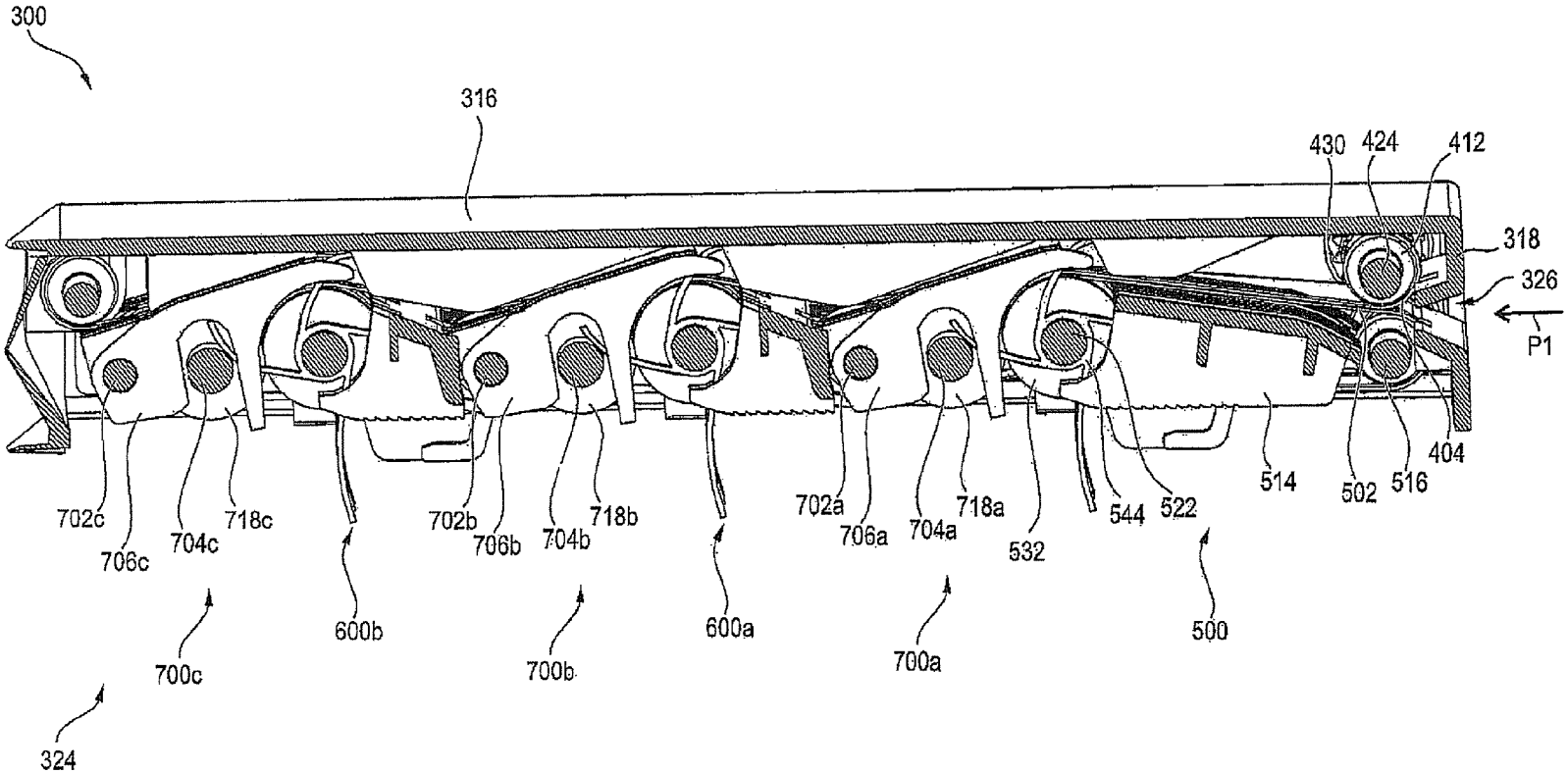
FIG. 21 shows a schematic perspective illustration of a longitudinal section of the cover according to FIGS. 15 and 16.
Figure 22:
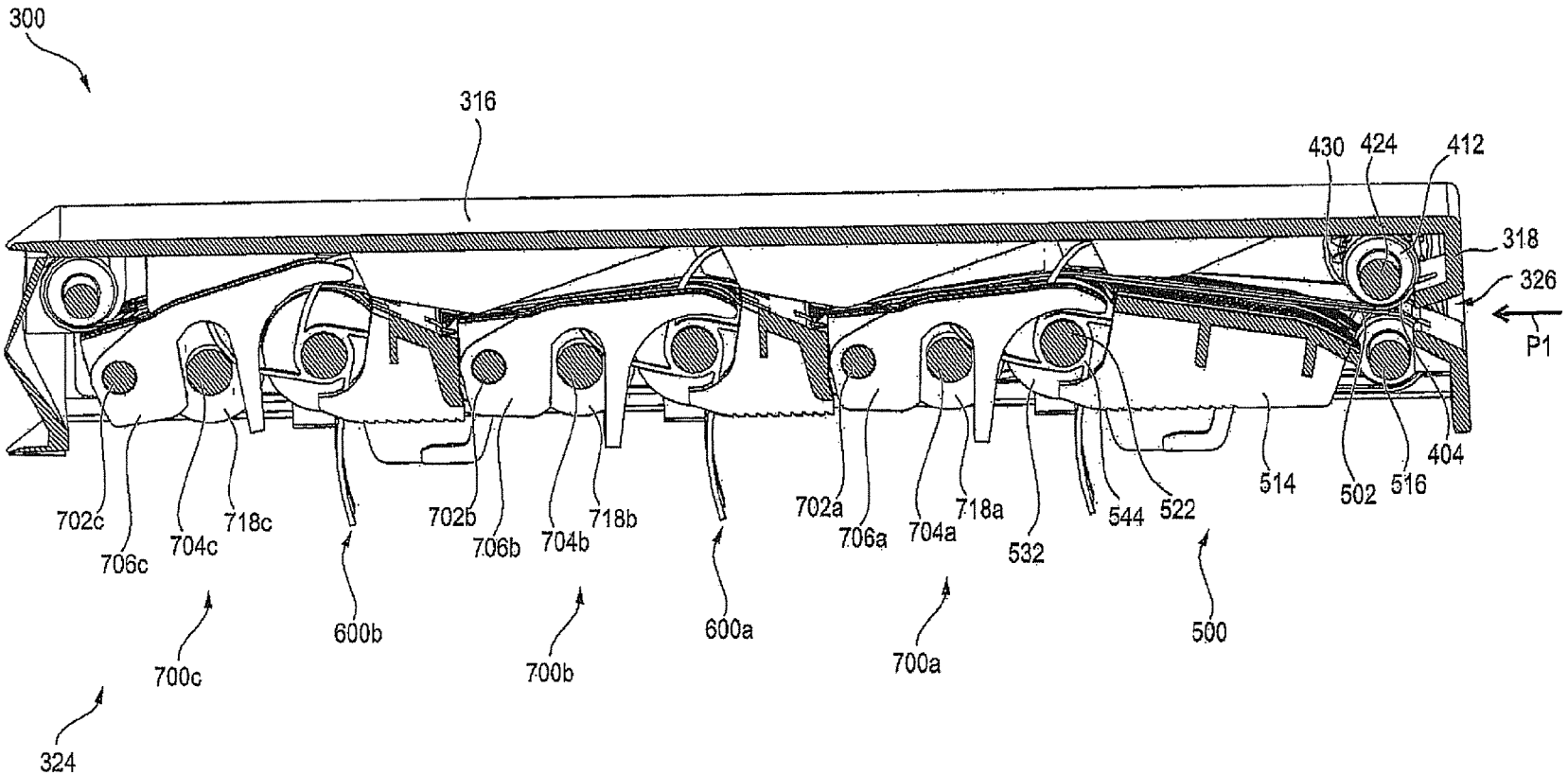
FIG. 22 shows a further schematic perspective illustration of a longitudinal section of the cover according to FIGS. 15 and 16.

In FIG. 21, a schematic perspective illustration of a longitudinal section of the cover 300 is shown. All three sorting gates 700*a* to 700*c* are illustrated in the diverting position. In FIG. 22, a further schematic perspective illustration of a longitudinal section of the cover 300 according to FIG. 21 is shown. The fingers 706*a* of the first sorting gate 700*a* and the fingers 706*a* of the second sorting gate 700*b* are illustrated in the lower position so that the notes of value that are transported along the transport path are stored in the third storage area 160*c* in the instance shown in FIG. 22.

Figure 23:
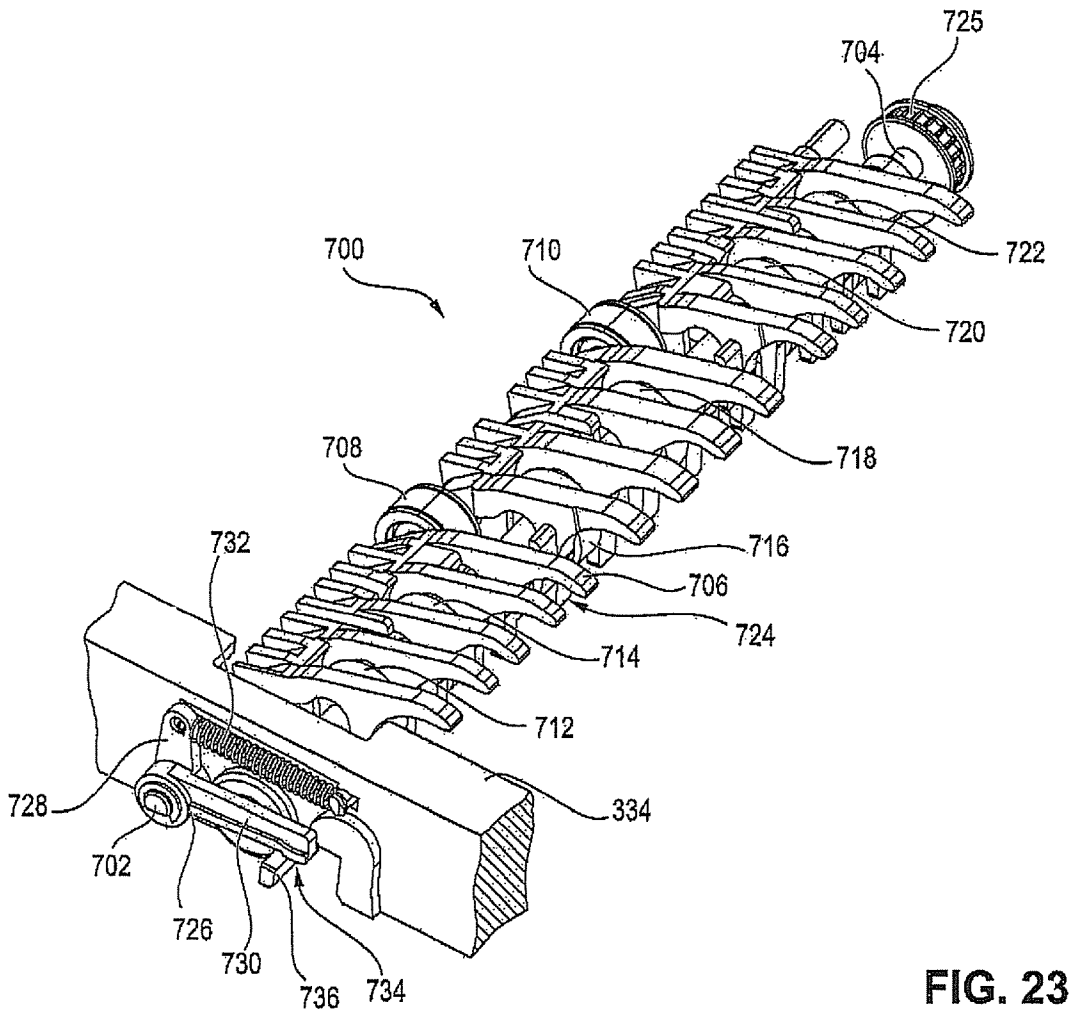
FIG. 23 shows a schematic perspective illustration of the sorting gate according to FIG. 19 and a side rail.

In FIG. 23, a schematic perspective illustration of the sorting gate 700 according to FIG. 19 and a detail of the second side rail 334 are shown. On the end of the second shaft 704 opposite to the second side rail 334 a gear wheel 725 is arranged which is firmly connected to the shaft 704. The shaft 704 is drivable by means of the gear wheel 725.

The second side rail 334 has a recess through which an end of the first shaft 702 projects. At the side of the second side rail 334 facing away from the shaft 700, a lever element 726 is arranged that is connected to the end of the first shaft 702 in a rotationally fixed manner. The lever element 726 is in particular substantially L-shaped. A first leg 728 of the lever element 726 is connected to the second side rail 334 via an elastic element 732, in particular a spring. The second leg 730 of the lever element 726 has a contact area 734 which contacts an upper end of the lifting rod 122, 124 allocated to the sorting gate 700. By means of the elastic element 732 and a stop 736, the lever element 726 is kept in a position in which the fingers 706 of the sorting gate 700 are arranged in a lower position. When the lifting rod 122, 124 is moved upward so that the upper end of the lifting rod 122, 124 presses against the contact area 734 and thus rotates the lever element 726 about the longitudinal axis of the first shaft 702, the fingers 706 are pivoted into the diverting position. When the lifting rod 122, 124 is again moved downward, then the fingers 706 are again pivoted into the lower position by the elastic element 732. In this way, it is guaranteed that the notes of value are only diverted from the transport path by means of the sorting gate 700 when the respective note of value is to be supplied to the storage area 160*a* to 160*c* allocated to the sorting gate 700.

The upward displacement of the lifting rods 122, 124 in particular takes place by means of a respective lifting magnet arranged outside the value note cassette 10. Thus, it is achieved that an actuating mechanism within the value note cassette 10 can be dispensed with, as a result whereof installation space is saved and the value note cassette 10 can be produced cost-efficiently.

Figure 24:
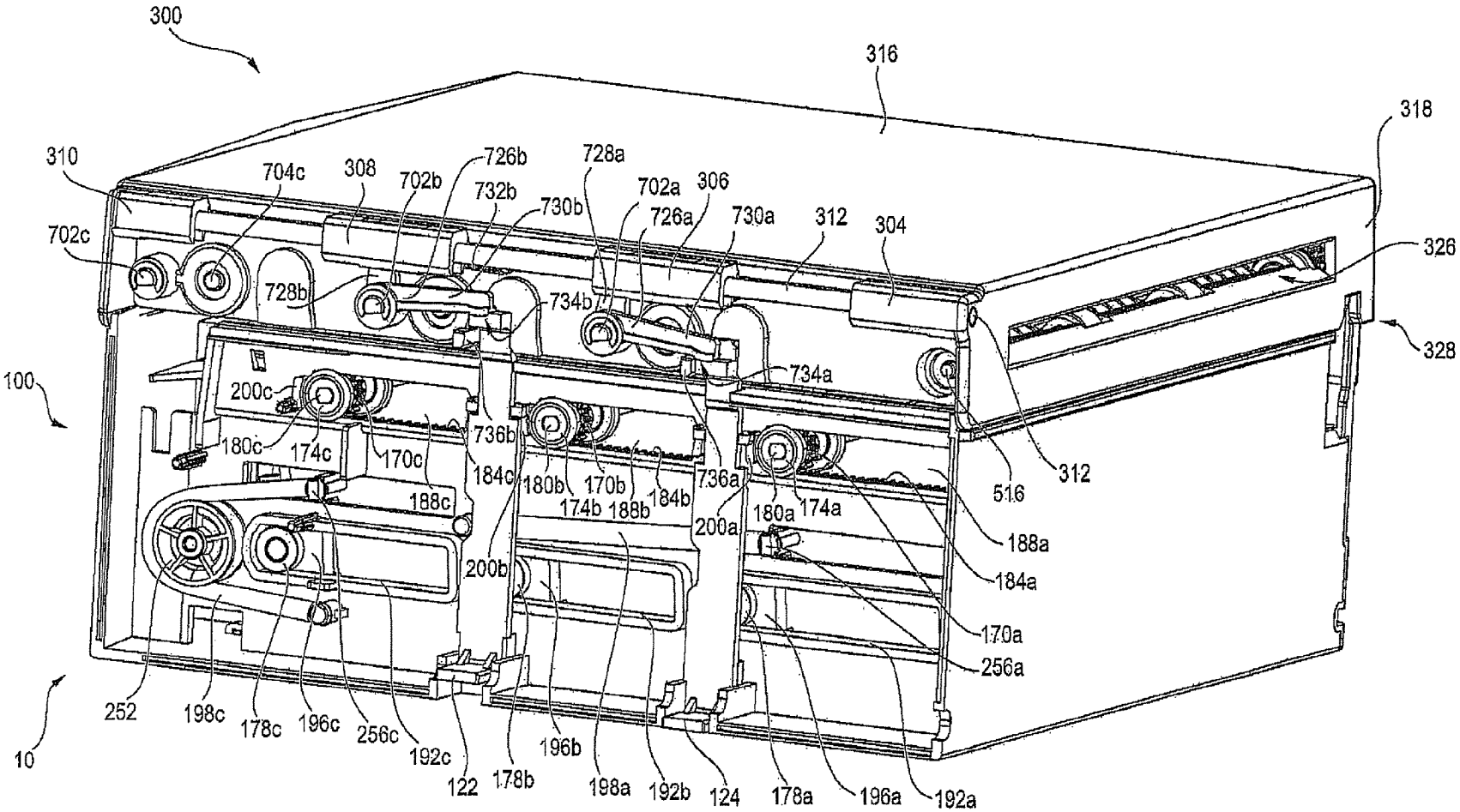
FIG. 24 shows a schematic perspective illustration of the value note cassette according to FIGS. 1 to 4, with a view onto the second side wall of the base.

In FIG. 24, a schematic perspective illustration of the value note cassette 10 is shown, with a view onto the second side wall 134 of the base 100. The first lifting rod 124 is not displaced upward so that the first lever element 726 is not rotated upward and the fingers 706*a* of the first sorting gate 700*a* are arranged in the lower position.

The second lifting rod 122, in contrast, is moved upward by means of a lifting magnet not illustrated so that the fingers 706*b* of the second sorting gate 700*b* are arranged in the diverting position. In the position of the sorting gates 700*a*, 700*b* illustrated in FIG. 24, the notes of value transported along the transport path are thus supplied to the second storage area 160*b*.

The third sorting gate 700*c* has no lever element and no lifting rod either as the fingers 706*c* of the third sorting gate 700*c* are firmly arranged in the diverting position. As the sorting gate 700*c* is arranged at the end of the transport path, all notes of value that have not already been supplied to the first storage area 160*a* or the second storage area 160*b* have to be supplied to the third storage area 160*c*. As the corresponding component parts for moving the sorting gate 700*c* are dispensed with, costs and expenses are saved.

In a preferred embodiment of the invention, the value note cassette 10 comprises two light barriers, one light barrier determining the position of the first sorting gate 700*a* and one light barrier determining the position of the second sorting gate 700*b*. As a result thereof, the sorting gate positions can be determined easily and immediately. The light barriers are preferably electrically connected via the plug connector 116 to a central electronics of the automated teller machine in which the value note cassette 10 is accommodated.

Figure 25:
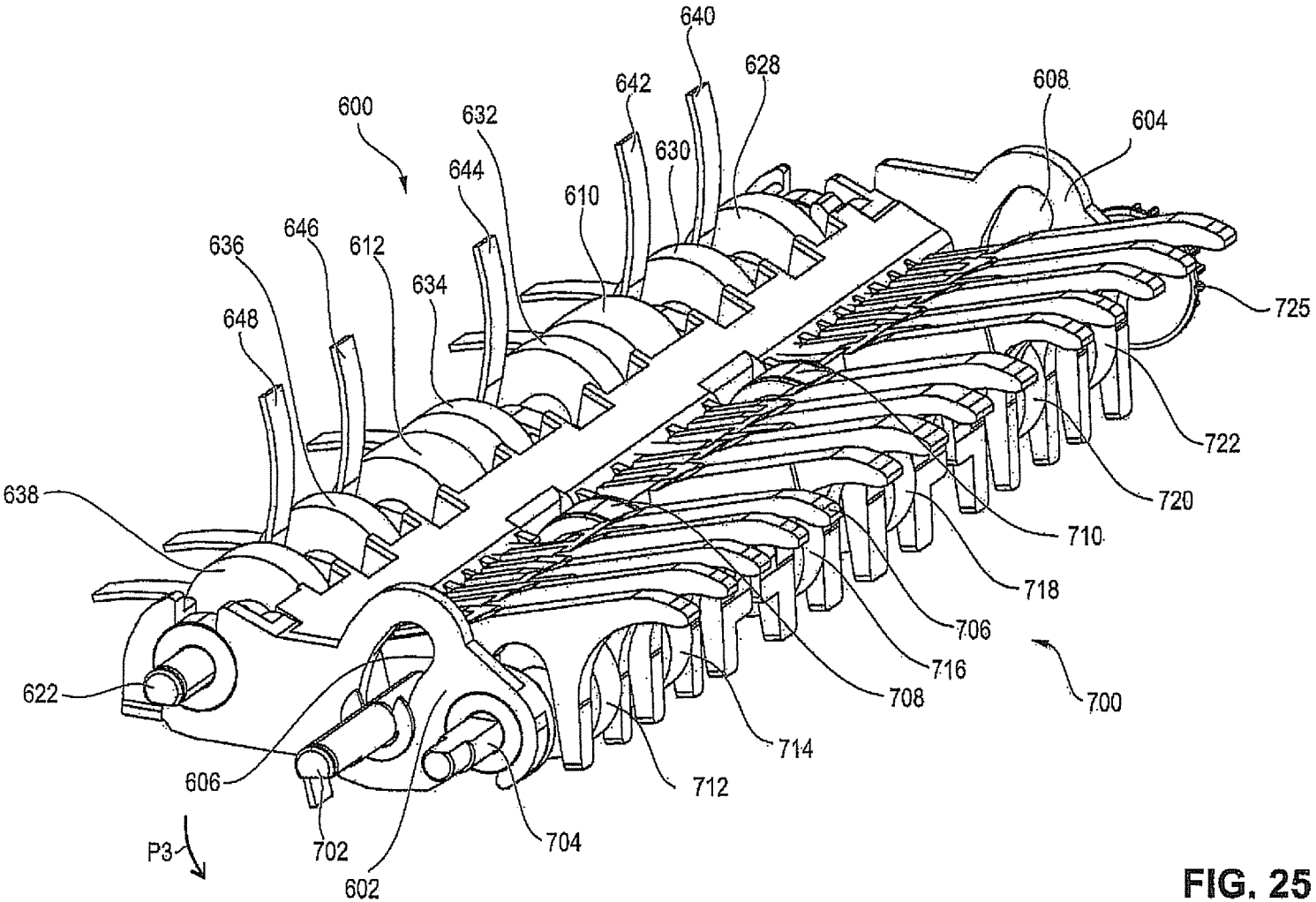
FIG. 25 shows a schematic perspective illustration of sorting gate according to FIG. 19 and an intermediate transport unit.

In FIG. 25, a schematic perspective illustration of the sorting gate 700 and an intermediate transport unit 600 is illustrated. The second shaft 704 of the sorting gate 700 is connected to the non-illustrated side rails 332, 334 in a rotationally fixed and stationary manner. The intermediate transport unit 600 is connected via two connecting elements 602, 604 to the second shaft 704 of the sorting gate 700 pivotably relative to the side rails 332, 334. The intermediate transport unit 600 is itself not connected to the side rails 332, 334 and/or the housing 314 of the cover 300. The connecting elements 602, 604 of the intermediate transport unit 600 have a respective slot 606, 608 through which the first shaft 702 of the sorting gate 700 projects. The slots 606, 608 are in particular designed such that the intermediate transport unit 600 is pivotable in the direction of the arrow P3 in the direction of the base 100 of the value note cassette 10. In this way, it is achieved that the intermediate transport unit 600 can be hinged downward so that the part of the transport path that is delimited by the intermediate transport unit 600 from below is easily accessible. As a result thereof, value note jams at this position can easily be removed. In an advantageous embodiment of the invention, also the front-end transport unit 500 can be hinged downward.

Further, the intermediate transport unit 600 comprises a shaft 622, the structure of which is analogous to the shaft 522 of the front-end transport unit 500. Accordingly, altogether six rolls 628 to 638 and five vane wheels 640 to 648 are arranged on the shaft 622.

In an alternative embodiment of the invention, the supply unit 324 is not arranged within the cover 300 but outside the value note cassette 10. By arranging the supply unit 324 within the cover 300 it is achieved that no installation space for a further supply unit is required outside the value note cassette 10.

The shafts 422, 424, 436 to 442, 516, 522, 622, 702, 702*a* to 702*c*, 704, 704*a* to 704*c* are preferably made of aluminum.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A value note cassette comprising:

a fixed first storage compartment for receiving notes of value, at least a fixed second storage compartment for receiving notes of value, and a supply unit for supplying the notes of value to the storage compartments, wherein the storage compartments are designed such that notes of value are stackable therein, wherein the value note cassette comprises a base, in particular a base comprising a bottom plate, a first side wall, a second side wall, a rear wall and a front wall, and a cover for closing an opening of the base, and wherein each storage compartment has a respective storage area for receiving the notes of value, and in that each of the storage areas is delimited by a part of the bottom plate, a part of the first side wall, a part of the second side wall, a fixed wall and a press-on wall mounted movably in the stacking direction of the notes of value.

2. The value note cassette according to claim 1, wherein at least a third storage compartment for receiving notes of value is provided which is designed such that notes of value are stackable therein.

3. The value note cassette according to claim 1, wherein the storage compartments are arranged in the base and the supply unit is arranged in the cover.

4. The value note cassette according to claim 1, wherein the cover is removable from the base or is a folding cover and in that the notes of value can be removed from the storage compartments in the base when the cover is removed or, respectively, hinged open.

5. The value note cassette according to claim 1, wherein the cover is firmly connectable to the base by means of a locking mechanism.

6. The value note cassette according to claim 1, wherein each press-on wall is mounted via a respective first gear wheel on a first toothing of the first side wall, a respective second gear wheel on a first toothing of the second side wall, a respective first roll in a first groove of the first side wall, a respective second roll in a second groove of the first side wall, a respective third roll in a first groove of the second side wall and a respective fourth roll in a second groove of the second side wall.

7. The value note cassette according to claim 1, wherein the press-on wall does not contact the bottom plate.

8. The value note cassette according to claim 1, wherein each press-on wall is connected to the first side wall or the second side wall by means of at least one elastic element, the at least one elastic element keeping the press-on wall in a position in which the press-on wall has a distance to the fixed wall so that between the press-on wall and the fixed wall a supply area for supplying notes of value is formed.

9. The value note cassette according to claim 1, wherein each fixed wall has at least one recess through which a part of a roll rotatably mounted on the side of the fixed wall facing away from the storage area projects into the storage area, which roll contacts the notes of value when the notes of value are supplied to the storage area.

10. The value note cassette according to 1, wherein each fixed wall comprises at least one spacer by which notes of value whose short sides fall below a minimum length are kept at least temporarily at a distance to the bottom plate during stacking of the notes of value into the storage area.

11. The value note cassette according to claim 1, wherein the bottom plate has at least one projection extending in the stacking direction of the notes of value on the surface delimiting the storage area.

12. The value note cassette according to claim 1, wherein the storage compartments are arranged behind one another as viewed in a transport direction of the notes of value.

13. The value note cassette according to claim 1, wherein the cover only has one inlet opening through which the notes of value to be supplied to the storage compartments are supplied to the supply unit.

14. The value note cassette according to claim 1, wherein the supply unit is drivable via a drive unit.

15. The value note cassette according to claim 1, wherein the supply unit has a transport path, and a substantially horizontal transport path along which the notes of value are transported in a transport direction.

16. The value note cassette according to claim 15, wherein the transport path is delimited by at least one driven belt extending in the transport direction of the notes of value on the side facing away from the base, which belt contacts the notes of value to be transported and transports them in the transport direction.

17. The value note cassette according to claim 15, wherein a housing of the cover comprises at least one rib by which the notes of value to be transported are guided during the transport along the transport path at least in a section thereof.

18. The value note cassette according to claim 15, wherein the supply unit comprises at least one sorting gate for diverting notes of value from the transport path and for supplying the notes of value to one of the storage compartments.

19. The value note cassette according to claim 18, wherein the supply unit comprises several sorting gates, one sorting gate each being arranged such that by means of it notes of value can be supplied to one of the storage compartments.

20. The value note cassette according to claim 19, wherein one transport unit for the transport of the notes of value along the transport path is provided between two adjacent ones of the several sorting gates and between an inlet opening of the cover and a first sorting gate as viewed in the transport direction of the notes of value.

21. The value note cassette according to claim 20, further comprising transport units that are mounted pivotally.

22. The value note cassette according to claim 19, wherein an upstream shaft is arranged upstream of each sorting gate as viewed in the transport direction, on which the upstream shaft at least one vane wheel comprising at least one vane is arranged, the vane of which presses a note of value supplied to the respective storage compartment against the value note stack already contained in the storage compartment and displaces the note of value, the value note stack and the press-on wall in the stacking direction of the notes of value.

23. The value note cassette according to claim 18, wherein each sorting gate comprises a shaft and at least one finger connected to the shaft in a rotationally fixed manner, wherein in a diverting position, the at least one finger is arranged such that at least a part of a contact area of the finger projects into the transport path and supplies notes of value transported along the transport path to the storage compartment allocated to the sorting gate.

24. The value note cassette according to claim 23, wherein the contact area is bent, in particular bent by more than 90° .

25. The value note cassette according to claim 23, wherein at least one roll is arranged between two fingers of the at least one finger on the shaft and in that the roll contacts the notes of value that are not to be supplied to the storage compartment allocated to the at least one sorting gate when the fingers are pivoted into a lower position.

26. The value note cassette according to claim 25, wherein at one end of the a first shaft a lever element for pivoting the at least one finger from the lower position into the diverting position is arranged, which lever element is connected via at least one elastic element to a side rail of the cover and which is connected to the first shaft in a rotationally fixed manner, the at least one elastic element being arranged such that the at least one finger is held in the lower position.

27. The value note cassette according to claim 26, wherein the base comprises a vertically extending translation element for transmitting a translatory movement, which element is movable in its longitudinal direction such that by means of it the at least one finger is pivotable from the lower position into the diverting position as a result of a pivoting the lever element.

28. The value note cassette according to claim 27, wherein the translation element is movable by means of a lifting magnet drive arranged outside the value note cassette.

29. The value note cassette according to claim 23, wherein the shaft is a first shaft and in that at least one roll for supplying the diverted notes of value to a storage compartment is provided, which roll is arranged on a second shaft running parallel to the first shaft and is connected to the second shaft in a rotationally fixed manner.

* * * * *